US008237639B2

(12) United States Patent
Yamashita et al.

(10) Patent No.: US 8,237,639 B2
(45) Date of Patent: Aug. 7, 2012

(54) IMAGE DISPLAY DEVICE

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 1050 days.

(21) Appl. No.: 11/802,640

(22) Filed: May 24, 2007

(65) Prior Publication Data

US 2007/0273621 A1 Nov. 29, 2007

(30) Foreign Application Priority Data

May 29, 2006 (JP) ..... P2006-147537

(51) Int. Cl.
*G09G 3/32* (2006.01)

(52) U.S. Cl. ..... 345/82; 345/76; 345/77; 345/83; 345/690; 315/169.1; 315/169.3

(58) Field of Classification Search ..... 345/76
See application file for complete search history.

(56) References Cited

U.S. PATENT DOCUMENTS

| | | | | |
|---|---|---|---|---|
| 5,670,792 | A * | 9/1997 | Utsugi et al. | 257/59 |
| 6,693,388 | B2 * | 2/2004 | Oomura | 315/169.3 |
| 7,710,368 | B2 * | 5/2010 | Chung | 345/82 |
| 2003/0231152 | A1 * | 12/2003 | Shin | 345/83 |
| 2004/0196223 | A1 * | 10/2004 | Kwon | 345/82 |
| 2004/0251953 | A1 * | 12/2004 | Yamazaki et al. | 327/512 |
| 2005/0052366 | A1 * | 3/2005 | Kim | 345/76 |
| 2005/0093799 | A1 * | 5/2005 | Lo | 345/92 |
| 2005/0174306 | A1 * | 8/2005 | Agari et al. | 345/76 |
| 2005/0237281 | A1 * | 10/2005 | Tam | 345/76 |
| 2005/0259142 | A1 * | 11/2005 | Kwak | 347/238 |
| 2005/0269959 | A1 * | 12/2005 | Uchino et al. | 315/169.3 |
| 2005/0270257 | A1 * | 12/2005 | Shin | 345/76 |
| 2006/0007073 | A1 * | 1/2006 | Kwak et al. | 345/76 |
| 2006/0077138 | A1 * | 4/2006 | Kim | 345/76 |
| 2006/0103323 | A1 * | 5/2006 | Eom et al. | 315/169.3 |
| 2006/0114193 | A1 * | 6/2006 | Kwak et al. | 345/76 |
| 2006/0156121 | A1 * | 7/2006 | Chung | 714/726 |

FOREIGN PATENT DOCUMENTS

| | | |
|---|---|---|
| JP | 2003-108067 | 4/2003 |
| JP | 2003-255856 | 9/2003 |
| JP | 2003-271095 | 9/2003 |
| JP | 2004-029791 | 1/2004 |
| JP | 2004-093682 | 3/2004 |
| JP | 2004-133240 | 4/2004 |
| JP | 2004-334163 | 11/2004 |
| JP | 2005-157244 | 6/2005 |
| JP | 2005-258415 | 9/2005 |
| JP | 2005-316385 | 11/2005 |
| JP | 2005-345722 | 12/2005 |
| JP | 2005-345723 | 12/2005 |

OTHER PUBLICATIONS

Choi et al, A self-compensated voltage programming pixel structure for active-matrix organic light emitting diodes, International Display Workshop 2003, pp. 535-538.*

Japanese Office Action dated May 30, 2008 for corresponding Japanese Application No. 2006-147537.

* cited by examiner

*Primary Examiner* — William Boddie
*Assistant Examiner* — Dorothy Harris
(74) *Attorney, Agent, or Firm* — Rader Fishman & Grauer, PLLC

(57) ABSTRACT

Herein disclosed is an image display device including a pixel circuit array portion, a scanner portion, and a signal portion.

6 Claims, 17 Drawing Sheets

(PRECEDING DEVELOPMENT)

(PRECEDING DEVELOPMENT)

(PRECEDING DEVELOPMENT)

(PRECEDING DEVELOPMENT)

$$I_{ds} = k\mu\,(V_{gs}-V_{th})^2 = k\mu\,(V_{sig}-\Delta V)^2$$

IMAGE DISPLAY DEVICE

CROSS REFERENCE TO RELATED APPLICATIONS

The present invention contains subject matter related to Japanese Patent Application JP 2006-147537 filed in the Japanese Patent Office on May 29, 2006, the entire contents of which are incorporated herein by reference.

BACKGROUND OF THE INVENTION

1. Field of the Invention

The present invention relates to an image display device in which a light emitting element, such as an organic EL device, is used in a pixel. Particularly, the invention relates to an active matrix type image display device for driving light emitting elements by scanning transistors formed in pixels, respectively. More particularly, the invention relates to a technique for reducing the number of plural scanning lines which are provided in rows of pixels.

2. Description of the Related Art

In an image display device, such as a liquid crystal display device, a large number of liquid crystal elements are disposed in a matrix and a transmission intensity or a reflection intensity of an incident light is controlled every pixel in accordance with information on an image to be displayed, thereby displaying the image on a screen. Although this similarly applies to an organic EL display device in which an organic EL element is used in a pixel, unlike a liquid crystal element, the organic EL element is a self light emitting element. For this reason, the organic EL display device, for example, is advantageous in that an image displayed thereon has higher visibility than that in the liquid crystal display device, a backlight is unnecessary, and a response speed is high. Moreover, the organic EL display device is much more different from the liquid crystal display device or the like which is of a voltage control type in that it is of a so-called current control type because a luminance level (gradation) of each of the light emitting elements can be controlled by a value of a current caused to flow through a corresponding one of the light emitting elements.

For the organic EL display device, similarly to the liquid crystal display device, a simple matrix system and an active matrix system are adopted as a system for driving the organic EL display device. The former involves such a problem that it is difficult to realize a large display device having a high definition, although it is simple in constitution. For this reason, at present, the organic EL display device utilizing the active matrix system is actively developed. According to the active matrix system, a current which is caused to flow through a light emitting element provided inside each of pixel circuits is controlled by an active element (generally a thin film transistor (TFT)) provided inside a corresponding one of the pixel circuits. The organic EL display device utilizing the active matrix system, for example, is disclosed in Japanese Patent Laid-Open Nos. 2003-255856, 2003-271095, 2004-133240, 2004-029791, and 2004-093682.

SUMMARY OF THE INVENTION

A pixel circuit of the related art is disposed in a portion in which a corresponding one of the scanning lines disposed in rows for supplying control signals and a corresponding one of the signal lines disposed in columns for supplying a video signal intersect each other. Also, the pixel circuit of the related art includes at least a sampling transistor, a pixel capacitor, a drive transistor, and a light emitting element. The sampling transistor is turned ON in accordance with a corresponding one of the control signals supplied thereto through the corresponding one of the scanning lines, and samples the video signal supplied thereto through the corresponding one of the signal lines. The pixel capacitor holds therein an input voltage corresponding to the video signal thus sampled. The drive transistor supplies an output current for a predetermined period of time for light emission in correspondence to the input voltage held in the pixel capacitor. Note that, in general, the output current has a dependency on a carrier mobility and a threshold voltage in a channel region of the drive transistor. Also, the light emitting element emits a light with a luminance corresponding to the video signal by receiving the output current supplied thereto from the drive transistor.

The drive transistor receives the input voltage held in the pixel capacitor at its gate, and causes a current to flow between its source and drain, thereby charging across the light emitting element. In general, a light emission luminance of the light emitting element is proportional to the amount of charge across the light emitting element. Moreover, an amount of output current supplied from the drive transistor is controlled by the gate voltage, that is, the input voltage written to the pixel capacitor. In the pixel circuit of the related art, an amount of current supplied to the light emitting element is controlled by changing the input voltage applied to the gate of the drive transistor in accordance with the input video signal.

Here, operating characteristics of the drive transistor are expressed by Expression (1):

$$Ids=(1/2)\mu(W/L)Cox(Vgs-Vth)^2 \quad (1)$$

where Ids represents a drain current caused to flow between the source and the drain and is the output current supplied to the light emitting element in the pixel circuit, Vgs represents the gate voltage applied to the gate with a source voltage as a reference and is the above-mentioned input voltage in the pixel circuit, Vth represents the threshold voltage of the transistor, μ represents, a mobility in a semiconductor thin film constituting a channel of the transistor, W represents a channel width, L represents a channel length, and Cox represents a gate capacity. As can be seen from the transistor operating characteristics expressed by Expression (1), when the thin film transistor operates in a saturation region, if the gate voltage Vgs increases to exceed the threshold voltage Vth, the thin film transistor is turned ON to cause the drain current Ids between the source and the drain. In principle, as shown by Expression (1), the same amount of drain current Ids is usually supplied to the light emitting element as long as the gate voltage Vgs is held constant. Therefore, if video signals having the same level are supplied to all the pixels constituting the screen, respectively, all the pixels ought to emit lights with the same luminance, thereby obtaining uniformity of the picture.

However, actually, there is a dispersion of the individual device characteristics in the thin film transistors (TFTs), each of which is constituted by a semiconductor thin film made of polysilicon or the like. In particular, the threshold voltages Vth are not fixed, and thus disperse in the pixels. As apparent from Expression (1), when the threshold voltages Vth of the drive transistors disperse, even if the gate voltages Vgs are fixed, the drain currents Ids disperse, and thus the luminances disperse in the pixels. As a result, the uniformity of the picture is impaired. Heretofore, the pixel circuit in which a function of canceling the dispersion of the threshold voltages of the drive transistors is incorporated has been developed. This sort of pixel circuit, for example, is disclosed in Japanese Patent Laid-Open No. 2004-133240.

However, the image display device of the related art in which the function (threshold voltage correcting function) of canceling the dispersion of the threshold voltage is incorporated is completed in the structure of the pixel circuit. Also, the image display device includes a plurality of transistors in addition to the drive transistors for driving the light emitting elements, respectively. Since these transistors need to be driven in a one pass scan manner by scanning the scanning lines disposed in rows in the one pass scan manner, a plurality of scanning lines are necessary per row of the pixels. For this reason, a number of crossover laps are placed among the scanning lines (gate lines), the signal lines and the power source lines. This causes a yield of the panel constituting the image display device to be reduced. In addition, since a plurality of scanning lines needs to be driven per row of the pixels, scanners need to be provided by the number of scanning lines. This causes a reduction in yield and cost-down.

In light of the above-mentioned related art, it therefore is desirable to reduce the number of scanning lines in an image display device including a threshold voltage correcting function, thereby improving the yield.

According to an embodiment of the present invention, there is provided an image display device including a pixel circuit array portion, a scanner portion, and a signal portion; the pixel circuit array portion includes a plurality of scanning lines disposed every row, a signal line disposed every column, and pixel circuits disposed in matrix in portions in which the scanning lines disposed in rows, and the signal lines disposed in columns intersect each other, respectively; the signal portion supplies video signals to the signal lines, respectively; the scanner portion scans successively the pixel circuits every row by supplying control signals to the plurality of scanning lines, respectively, including main scanning lines, sub scanning lines and scanning lines for correction; each of the pixel circuits includes a sampling transistor, a drive transistor, a first switching transistor, a second switching transistor, a third switching transistor, a pixel capacitor, and a light emitting element; the sampling transistor is turned ON in accordance with a corresponding one of the control signals supplied thereto through a corresponding one of the main scanning lines for a predetermined period of time for sampling to sample and hold a signal potential of a corresponding one of the video signals supplied thereto through a corresponding one of the signal lines in the pixel capacitor; the pixel capacitor applying an input voltage to a gate of the drive transistor in correspondence to the signal potential of the corresponding one of the video signals thus sampled; the drive transistor supplies an output current corresponding to the input voltage to the light emitting element; the light emitting element emits a light with a luminance corresponding to the signal potential of the corresponding one of the video signals by receiving an output current supplied thereto from the drive transistor for a predetermined period of time for light emission; the first switching transistor is turned ON in accordance with a corresponding one of the control signals supplied thereto from the scanner portion prior to the period of time for sampling to set a potential of a gate of the drive transistor to a first reference potential; the second switching transistor is turned ON in accordance with a corresponding one of the control signals supplied thereto from the scanner portion prior to the period of time for sampling; the third switching transistor being turned ON in accordance with a corresponding one of the control signals supplied thereto through a corresponding one of the sub scanning lines prior to the period of time for sampling to connect the drive transistor to a power source potential to hold a voltage corresponding to a threshold voltage of the drive transistor in the pixel capacitor, thereby correcting an influence of the threshold voltage, the third switching transistor also being turned ON in accordance with the corresponding one of the control signals supplied thereto through the corresponding one of the sub scanning lines again for the period of time for light emission to connect the drive transistor to the power source potential, thereby causing the output current to flow through the light emitting element; and in which one of the first switching transistor and the second switching transistor operates by receiving the corresponding one of the control signals from the scanner portion through a corresponding one of the scanning lines for correction belonging to a corresponding one of the rows, and the other of the first switching transistor and the second switching transistor operates by receiving the corresponding one of the control signals from the scanner portion through a corresponding one of the scanning lines for correction belonging to the row before or after the corresponding one of the rows, so that the first switching transistor and the second switching transistor use the corresponding one of the scanning lines for correction in common.

Preferably, the other of the first switching transistor and the second switching transistor operates by receiving the corresponding one of the control signals from the scanner portion through the corresponding one of the scanning lines for correction belonging to the row right before or right after the corresponding one of the rows. Preferably, a time width of the corresponding one of the control signals which the scanner portion supplies to the corresponding one of the scanning lines for correction is set longer than a period of time necessary for correcting an influence of the threshold voltage. Preferably, an output current of the drive transistor has a dependency on a carrier mobility in a channel region, and the third switching transistor is turned ON for the period of time for sampling to correct the drive transistor to the power source potential, takes out an output current from the drive transistor while the signal potential is sampled, and negatively feeds the output current back to the pixel capacitor to correct the input voltage, thereby canceling the dependency of the output current on the carrier mobility.

According to the embodiment of the present invention, in addition to the drive transistor for driving the light emitting element and the sampling transistor for sampling and holding the video signal in the corresponding one of the pixel circuits, a plurality of switching transistors is incorporated in each of the pixel circuits which are formed integrally with one another in the image display device. Here, the plurality of switching transistors performs the threshold voltage correcting operation and the mobility correcting operation for the drive transistor. Of these switching transistors, one of the first switching transistor and the second switching transistor normally operates by receiving the corresponding one of the control signals from the scanner portion through the corresponding one of the scanning lines for correction belonging to the corresponding one of the rows. On the other hand, the other of the first switching transistor and the second switching transistor operates by receiving the corresponding one of the control signals from the scanner portion through the corresponding one of the scanning lines for correction belonging to the row before or after the corresponding one of the rows. With such a constitution, the first switching transistor and the second switching transistor can use the corresponding one of the scanning lines for correction in common. The number of gate lines can be reduced and also the crossover among the wirings can be reduced thereby improving the yield of the panel all the more, because at least the scanning lines for correction of the plurality of scanning lines disposed every pixel row is used in common.

DETAILED DESCRIPTION OF THE PREFERRED EMBODIMENTS

Figure 1:
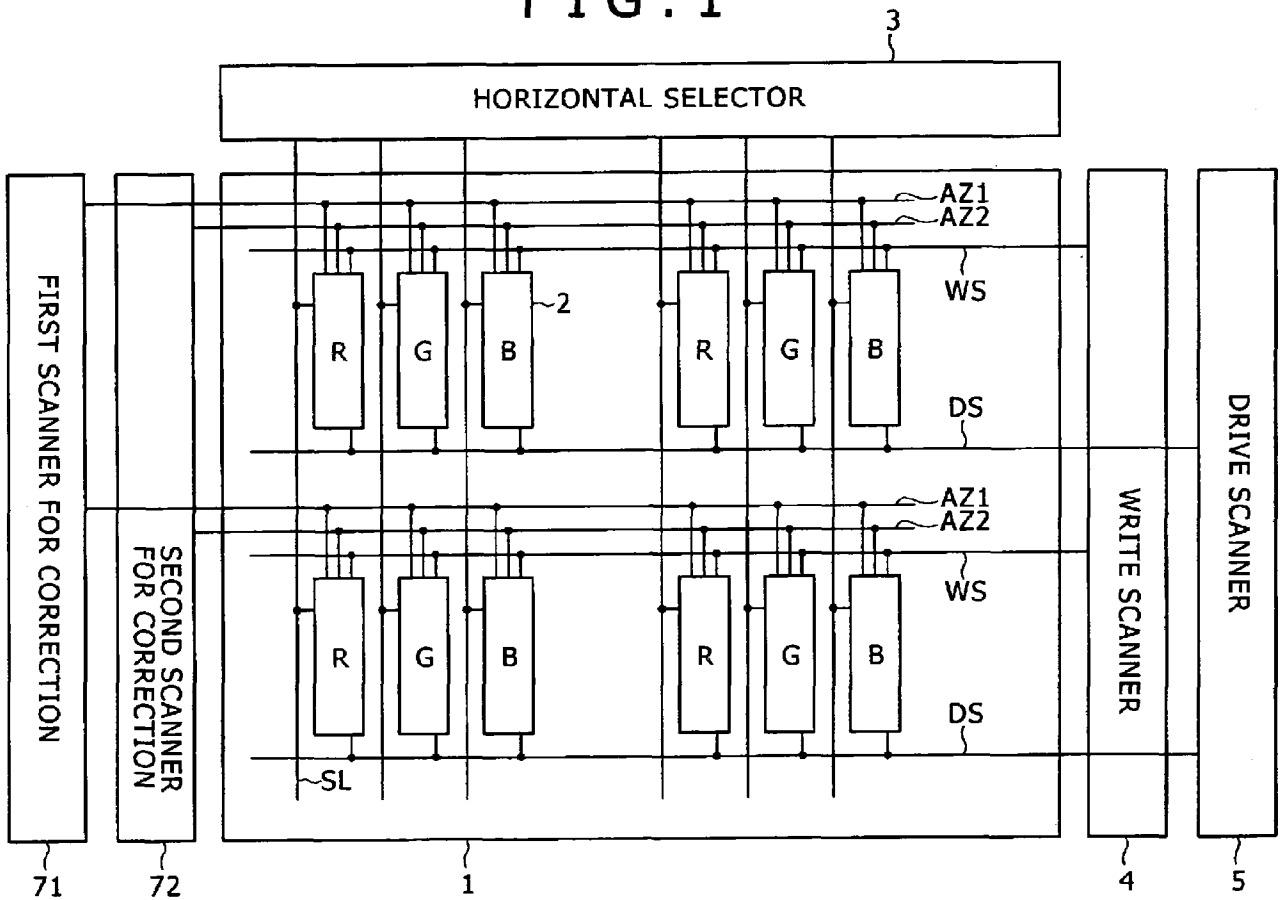
FIG. 1 is a block diagram showing an image display device according to a preceding development example.

Preferred embodiments of the present invention will be described in detail hereinafter with reference to the accompanying drawings. Firstly, a description will now be given with respect to an image display device according to a preceding development example as the base of the present invention (it may be hereinafter referred to as "a preceding development example") with reference to FIG. 1. Since this preceding development example becomes the foundation of the present invention, and the greater part thereof overlaps in constitution with the present invention, the preceding development example is now concretely described as a part of the present invention. As illustrated in FIG. 1, this image display device includes a pixel array portion 1, a scanner portion, and a signal portion as a basic constitution. The pixel array portion 1 includes a plurality of scanning lines WS, DS, AZ1 and AZ2 which are disposed every row, a signal line SL which is disposed every column, and pixel circuits 2 which are disposed in a matrix in portions, respectively, in which the rows each having the scanning lines WS, DS, AZ1 and AZ2 and the columns each having the signal line SL intersect each other. In order to perform color display for an image, each of the pixel circuits 2 in the image display device can emit a light having any of the three primary colors of R, G and B. However, the present invention is not intended to be limited thereto, and thus it can be applied as well to an image display device for displaying thereon a monochromatic image, that is, a black-and-white image. The signal portion includes a horizontal selector 3, and supplies video signals to the signal lines SL, respectively. In order that the scanner portion may successively scan the four scanning lines WS, DS, AZ1 and AZ2 in a one pass scan manner, the scanner portion is divided into a write scanner 4, a drive scanner 5, a first scanner 71 for correction, and a second scanner 72 for correction. The scanners 4, 5, 71 and 72 supply control signals to the main scanning line WS, the sub scanning line DS, and the scanning lines AZ1 and AZ2 for correction, respectively, and successively scan the pixel circuits 2 every row.

Figure 2:
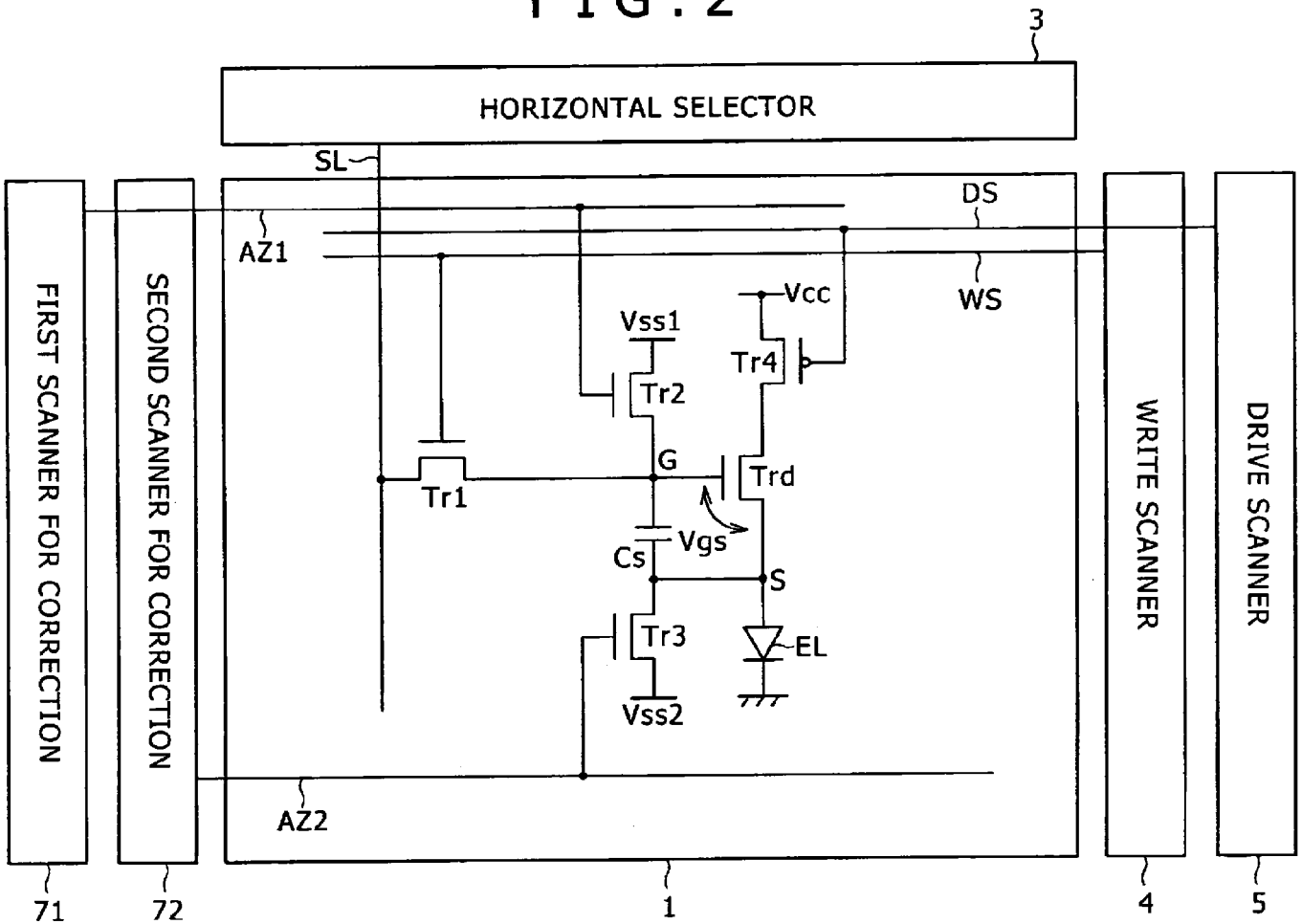
FIG. 2 is a circuit diagram showing a structure of a pixel circuit according to the preceding development example.

FIG. 2 is a circuit diagram showing a structure of the pixel circuit included in the image display device shown in FIG. 1. The pixel circuit 2 includes five thin film transistors Tr1 to Tr4 and Trd, one capacitor (pixel capacitor) Cs, and one light emitting element EL. Each of the transistors Tr1 to Tr3 and Trd is an N-channel polysilicon TFT. Only the transistor Tr4 is a P-channel polysilicon TFT. One capacitor Cs constitutes the pixel capacitor in this pixel circuit 2. The light emitting element EL, for example, is a diode type organic EL element having an anode and a cathode. However, the present invention is not intended to be limited thereto, and generally includes any of the devices which emit a light by current driving as the light emitting element.

A gate G of the drive transistor Trd as a central constituent element of the pixel circuit 2 is connected to one end of the pixel capacitor Cs, and a source S thereof is connected to the other end of the pixel capacitor Cs. In addition, the gate G of the drive transistor Trd also is connected to another reference potential Vss1 through the switching transistor Tr2. A drain of the drive transistor Trd is connected to a power source Vcc through the switching transistor Tr4. A gate of the switching transistor Tr4 is connected to the scanning line DS. The anode of the light emitting element EL is connected to the source S of the drive transistor Trd, and the cathode thereof is grounded. This ground potential may be designated with Vcath. In addition, the switching transistor Tr3 is interposed between the source S of the drive transistor Trd and the reference potential Vss2. A gate of the transistor Tr3 is connected to the scanning line AZ2. On the other hand, the sampling transistor Tr1 is connected between the signal line SL and the gate G of the drive transistor Trd. The gate of the sampling transistor Tr1 is connected to the scanning line WS.

With such a circuit structure, the sampling transistor Tr1 is turned ON in accordance with the control signal WS supplied thereto through the scanning line WS to sample and hold a video signal Vsig supplied through the signal line SL in the pixel capacitor Cs for a predetermined period of sampling. The pixel capacitor Cs applies an input voltage Vgs across the gate G and the source S of the drive transistor Trd in accordance with the video signal Vsig thus sampled. The drive transistor Trd supplies an output current Ids corresponding to the input voltage Vgs to the light emitting element EL for a predetermined period of time for light emission. Note that, the output current (drain current) Ids has a dependency on a carrier mobility μ and a threshold voltage Vth in a channel region of the drive transistor Trd. The light emitting element EL emits a light with a luminance corresponding to the video signal Vsig by receiving the output current Ids supplied thereto from the drive transistor Trd.

With regard to the feature of this preceding development example, the pixel circuit 2 includes correcting means constituted by the first to third switching transistors Tr2 to Tr4. Also, in order to cancel the dependency of the output current Ids on the carrier mobility μ, the correcting means corrects the input voltage Vgs previously held in the pixel capacitor Cs at the lead of the period of time for light emission. More specifically, the correcting means (the switching transistors Tr2 to Tr4) operates for a part of the period of time for sampling in accordance with the control signals WS and DS supplied thereto from the scanning lines WS and DS, respectively. Thus, the correcting means takes out the output current Ids from the drive transistor Trd in a state in which the video signal Vsig is sampled, and negatively feeds back the output current Ids thus taken out back to the pixel capacitor Cs, thereby correcting the input voltage Vgs. Moreover, in order to cancel the dependency of the output current Ids on the threshold voltage Vth, the correcting means (the switching transistors Tr2 to Tr4) previously detects the threshold voltage Vth of the drive transistor Trd prior to the period of time for sampling, and adds the threshold voltage Vth thus detected to the input voltage Vgs.

In the case of this preceding development example, the drive transistor Trd is the N-channel transistor, a drain thereof is connected to a power source Vcc side, and a source S thereof is connected to a light emitting element EL side. In this case, the above-mentioned correcting means takes out the output current Ids from the drive transistor Trd at the lead portion of the period of time for light emission overlapping the rear portion of the period of time for sampling. Also, the above-mentioned correcting means negatively feeds the output current Ids thus taken out back to a pixel capacitor Cs side. Here, the correcting means operates so that the output current Ids taken out from the source S side of the drive transistor Trd at the lead portion of the period of time for light emission is caused to flow into a capacitance component which the light emitting element EL has. More specifically, the light emitting element EL is constructed by a diode type light emitting element including an anode and a cathode, and an anode side thereof is connected to the source S of the drive transistor Trd, and a cathode side thereof is grounded. With this circuit structure, the correcting means (the switching transistors Tr2 to Tr4) previously sets a bias state of the light emitting element EL to a reverse bias state. Thus, the correcting means causes the diode type light emitting element EL to function as a capacitive element when the output current Ids taken out from the source S side of the drive transistor Trd is caused to flow into the light emitting element EL. Note that, the correcting means can adjust a time width t for which the output current Ids is taken out from the drive transistor Trd within the period of time for sampling. Thus, the correcting means optimizes an amount of output current Ids negatively fed back to the pixel capacitor Cs.

Figure 3:
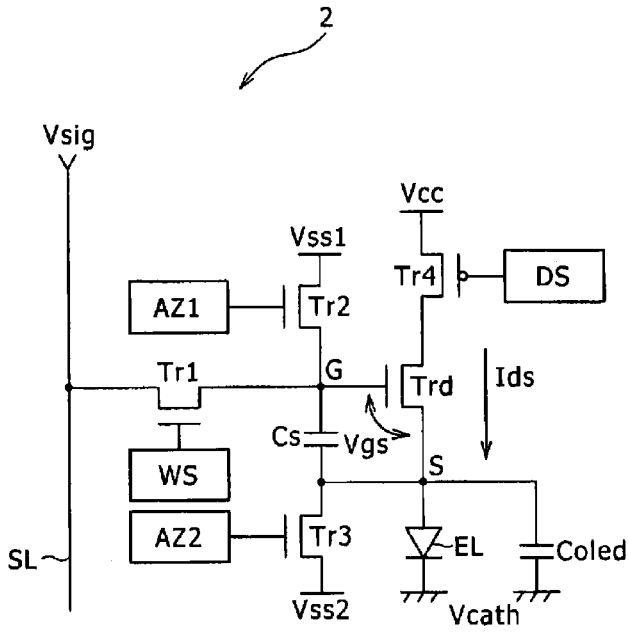
FIG. 3 is a schematic diagram showing the pixel circuit according to the preceding development example.

FIG. 3 is schematic diagram showing the pixel circuit portion taken out from the image display device shown in FIG. 2. In order to make understanding easy, the video signal Vsig, the input voltage Vgs and the output current Ids of the drive transistor Trd, and the capacitance component Coled are additionally illustrated in the figure. Here, as stated above, the video signal Vsig is sampled by the sampling transistor Trd, and the light emitting element EL has the capacitance component Coled. An operation of the pixel circuit 2 according to the preceding development example will be described hereinafter with reference to FIG. 3.

Figure 4:
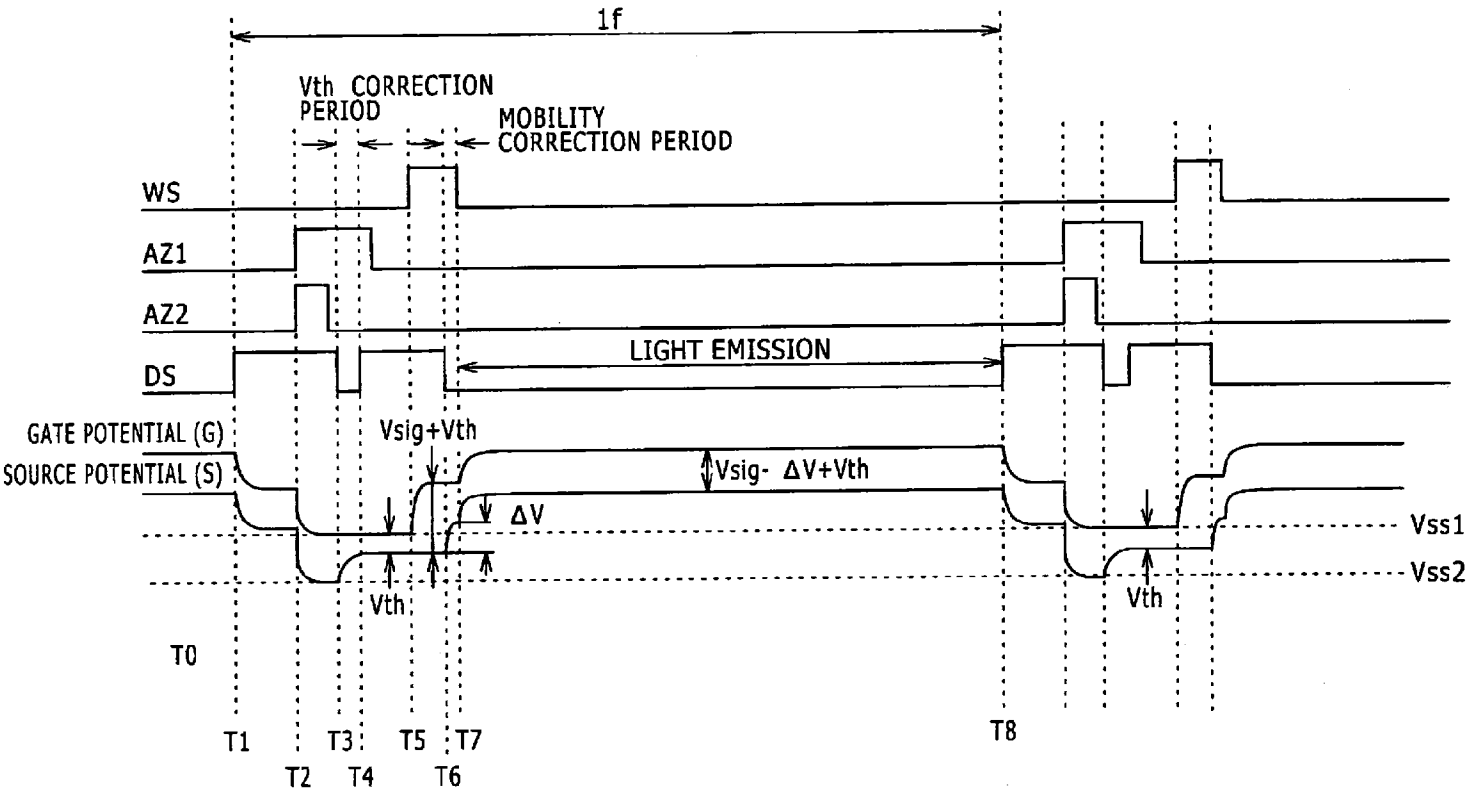
FIG. 4 is a timing chart explaining an operation of the pixel circuit shown in FIG. 3 of the preceding development example.

FIG. 4 is a timing chart explaining an operation of the pixel circuit 2 shown in FIG. 3. The operation of the pixel circuit 2 according to the preceding development example shown in FIG. 3 now will be more concretely described with reference to FIG. 4. FIG. 4 illustrates waveforms of the control signals applied to the scanning lines WS, AZ1, AZ2 and DS, respectively, along a time axis T. For the sake of simplification of a notation, the control signals also are designated with the same reference symbols as those of the corresponding scanning lines, respectively. Since each of the transistors Tr1, Tr2 and Tr3 is N-channel one, each of the transistors Tr1, Tr2 and Tr3 is turned ON when each of the scanning lines WS, AZ1 and AZ2 is at a high level, while each of them is turned OFF when each of the sampling lines WS, AZ1 and AZ2 is set at a low level. On the other hand, since the switching transistor Tr4 is P-channel one, the switching transistor Tr4 is turned OFF when the scanning line DS is at a high level, while it is turned ON when the scanning line DS is at a low level. Note that, this timing chart represents a potential change in the gate G and a potential change in the source S in the drive transistor Trd in the form of waveforms, respectively, together with the waveforms of the control signals WS, AZ1, AZ2 and DS.

The timing chart shown in FIG. 4 represents a period of time from a timing T1 to a timing T8 as one field (1*f*). Each of the rows in the pixel array is scanned once for one field. The timing chart represents the waveforms of the control signals WS, AZ1, AZ2 and DS which are applied to each of the pixels for one row.

Each of the control signals WS, AZ1, AZ2 and DS is at the low level at a timing T0 before the start of the field concerned. Therefore, each of the N-channel transistors Tr1, Tr2 and Tr3 is in the OFF state, while only the P-channel transistor Tr4 is in the ON state. Thus, since the drive transistor Trd is connected to the power source Vcc through the switching transistor Tr4 held in the ON state, it supplies the output current Ids to the light emitting element EL in accordance with the predetermined input voltage Vgs. Therefore, the light emitting element EL emits a light at the timing T0. At this time, the input voltage Vgs applied to the drive transistor Trd is expressed in the form of a difference between the gate potential (G) and the source potential (S) of the drive transistor Trd.

The control DS changes from the low level to the high level at the timing T1 at which the field concerned starts. As a result, since the switching transistor Tr4 is turned OFF, and thus the drive transistor Trd is disconnected from the power source Vcc, the light emission is stopped, and the operation enters a period of time for non-light emission. Therefore, when the operation enters the timing T1, each of the transistors Tr1 to Tr4 becomes the OFF state.

Subsequently, when the operation proceeds to the timing T2, the switching transistors Tr2 and Tr3 are turned ON since each of the control signals AZ1 and AZ2 becomes the high level. As a result, the gate G of the drive transistor Trd is connected to a reference potential Vss1, and the source S thereof is connected to a reference potential Vss2. Here, a relationship of (Vss1−Vss2)>Vth is met, and thus a relationship of (Vss1−Vss2=Vgs>Vth) is set, thereby performing preparation for Vth correction, which will be made in the subsequent timing T3. In other words, a period of time from the timing T2 to the timing T3 corresponds to a reset period of time of the drive transistor Trd. In addition, when a threshold voltage of the light emitting element EL is designated with VthEL, the threshold voltage VthEL is set so as to meet a relationship of VthEL>Vss2. Thus, a minus bias is applied to the light emitting element EL, and the light emitting element EL becomes a so-called reverse bias state. This reverse bias state is necessary for normally performing the Vth correcting operation and a mobility correcting operation which will be performed later.

At the timing T3, the control signal AZ2 is set at the low level, and the control signal DS also is set at the low level immediately after the setting of the control signal AZ2 at the low level. As a result, the switching transistor Tr3 is turned OFF, while the switching transistor Tr4 is turned ON. This result's in the drain current Ids being caused to flow into the pixel capacitor Cs to start the Vth correcting operation. At this time, the gate G of the drive transistor. Trd is held at Vss1, and thus the drain current Ids is continuously caused to flow into the pixel capacitor Cs until the drive transistor Trd is cut off. When the drive transistor Trd is cut off, the source potential (S) of the drive transistor Trd is set at (Vss1−Vth). At the timing T4 after the drain current Ids is cut off, the control signal DS is returned back to the high level again to turn OFF the switching transistor Tr4. Moreover, the control signal AZ1 also is returned back to the low level to turn OFF the switching transistor Tr2 as well. As a result, the threshold voltage Vth is held and fixed in the pixel capacitor Cs. As described above, the period of time from the timing T3 to the timing T4 corresponds to a period of time for which the threshold voltage Vth of the drive transistor Trd is detected. In this preceding development example, the period of time for detection from the timing T3 to the timing T4 is called the period of time for Vth correction.

At the timing T5 after the Vth correction is performed in the manner as described above, the control signal WS is changed from the low level over to the high level to turn ON the sampling transistor Tr1, thereby writing the video signal Vsig to the pixel capacitor Cs. A capacitance value of the pixel capacitor Cs is much smaller than an equivalent capacitance of the capacitance component Coled of the light emitting element EL. As a result, the greater part of the video signal Vsig is written to the pixel capacitor Cs. To put it more precisely, a different (Vsig−Vss1) between the video signal Vsig and the first reference potential Vss1 is written to the pixel capacitor Cs. Therefore, a voltage Vgs developed across the gate G and the source S of the drive transistor Trd is set at a level of (Vsig−Vss1+Vth) which is obtained by adding Vth previously detected and held to the difference (Vsig−Vss1) sampled this time. For the sake of simplicity of providing a description from now on, when the first reference potential Vss1 is regarded as being 0 V (Vss1=0 V), the gate to source voltage Vgs is expressed by (Vsig+Vth) as show in the timing chart of FIG. 4. The sampling of such a video signal Vsig is performed until a timing T7 at which the level of the control signal WS returns back to the low level. That is to say, a period of time from the timing T5 to the timing T7 corresponds to the period for sampling.

At the timing T6 just before the timing T7 at which the period of time for sampling is completed, the control signal DS is changed from the high level over to the low level to turn ON the switching transistor Tr4. As a result, since the drive transistor Trd is connected to the power source Vcc, the operation of the pixel circuit proceeds from the period of time for non-light emission to the period of time for light emission. The mobility connection for the drive transistor Trd is performed for the period of time from the timing T6 to the timing T7 for which the sampling transistor Tr1 is still held in the ON state and the operation of the switching transistor Tr4 enters the ON state as described above. That is to say, in this preceding development example, the mobility correction is performed for the period of time from the timing T6 to the timing T7 in which the rear portion of the period of time for sampling and the lead portion of the period of time for light emission overlap each other. Note that, the light emitting element EL emits no light because it is actually in the reverse bias state in the lead portion of the period of time for light emission for which the mobility correction is performed. For the period of time for mobility correction from the timing T6 to the timing T7, the drain current Ids is caused to flow through the drive transistor Trd in a state in which the gate G of the drive transistor Trd is fixed at the level of the video signal Vsig. Here, the light emitting element EL does not show diode characteristics, but shows simple capacitance characteristics because the light emitting element EL is put in the reverse bias state by setting a relationship of Vss1−Vth<VthEL. Thus, the drain current Ids caused to flow through the drive transistor Trd is written to a capacitor C having a capacitance value which is obtained by adding the capacitance value of the pixel capacitor Cs and the equivalent capacitance value of the capacitance component Coled of the light emitting element EL to each other (that is, C=Cs+Coled). As a result, the source potential (S) of the drive transistor Trd continuously increases. In the timing chart shown in FIG. 4, an increase in source potential (S) is expressed by ΔV. This increase ΔV in source potential (S) is finally subtracted from the gate to source voltage Vgs held in the pixel capacitor Cs, which means that the negative feedback is performed. The output current Ids of the drive transistor Trd is negatively fed back to the input voltage Vgs of the drive transistor Trd in the manner as described above, thereby making it possible to correct the mobility μ. Note that, an amount, ΔV, of source potential (S) negatively fed back to the input voltage Vgs can be optimized by adjusting the time width t of the period of time for mobility correction from the timing T6 to the timing T7.

At the timing T7, the control signal WS is changed from the high level over to the low level to turn OFF the sampling transistor Tr1. As a result, the gate G of the drive transistor Trd is disconnected from the signal line SL. Since application of the video signal Vsig is released, the gate potential (G) of the drive transistor Trd can increase. Thus, the gate potential (G) of the drive transistor Trd increases with the increase in source potential (S). For the duration of the increase in gate potential (G) of the drive transistor Trd, the gate to source voltage Vgs held in the pixel capacitor Cs maintains the value of (Vsig−ΔV+Vth). Since the reverse bias state of the light emitting element EL is cancelled along with the increase in source potential (S), the light emitting element EL actually starts to emit the light by receiving the output current Ids flowing thereinto. A relationship of the drain current Ids vs. the gate voltage Vgs at this time is given by Expression (2) by substituting (Vsig−ΔV+Vth) into Vgs in Expression (1):

$$Ids=k\mu(Vgs-Vth)^2=k\mu(Vsig-\Delta V)^2 \quad (2)$$

where k is expressed by (½)(W/L) Cox.

It is understood from Expression (2) that a term of Vth is cancelled, and thus the output current Ids supplied to the light emitting element EL does not depend on the threshold voltage Vth of the drive transistor Trd. The drain current Ids basically depends on the signal voltage Vsig of the video signal. In other words, the light emitting element EL emits the light with the luminance corresponding to the video signal Vsig. During the light emission, the video signal Vsig is corrected with the amount, ΔV, of source potential (S) negatively fed back to the input voltage Vgs. The amount, ΔV, of correction serves to cancel the effect of the mobility μ contained in the coefficient part of Expression (2). Therefore, the drain current Ids substantially depends only on the video signal Vsig.

Finally, when the operation reaches a timing T8, the control signal DS is changed from the low level over to the high level to turn OFF the switching transistor Tr4. As a result, the light emission is completed, and also the field concerned is completed. After that, the operation proceeds to the next field, and the Vth correcting operation, the mobility correcting operation and the light emitting operation are repeatedly carried out again.

However, in the pixel circuit according to the above-mentioned preceding development example, in order to scan the four kinds of transistors Tr1, Tr2, Tr3 and Tr4, it is necessary to form the four kinds of scanning lines (gate lines) WS, DS, AZ1 and AZ2. As a result, the number of crossovers of the scanning lines with the power source lines and the signal lines increases. This causes the yield to be reduced. Moreover, it becomes difficult to realize high definition in terms of the layout. Thus, it is desirable for the present invention to realize the common use of the gate lines, thereby reducing the number of scanning lines necessary per row.

Figure 5:
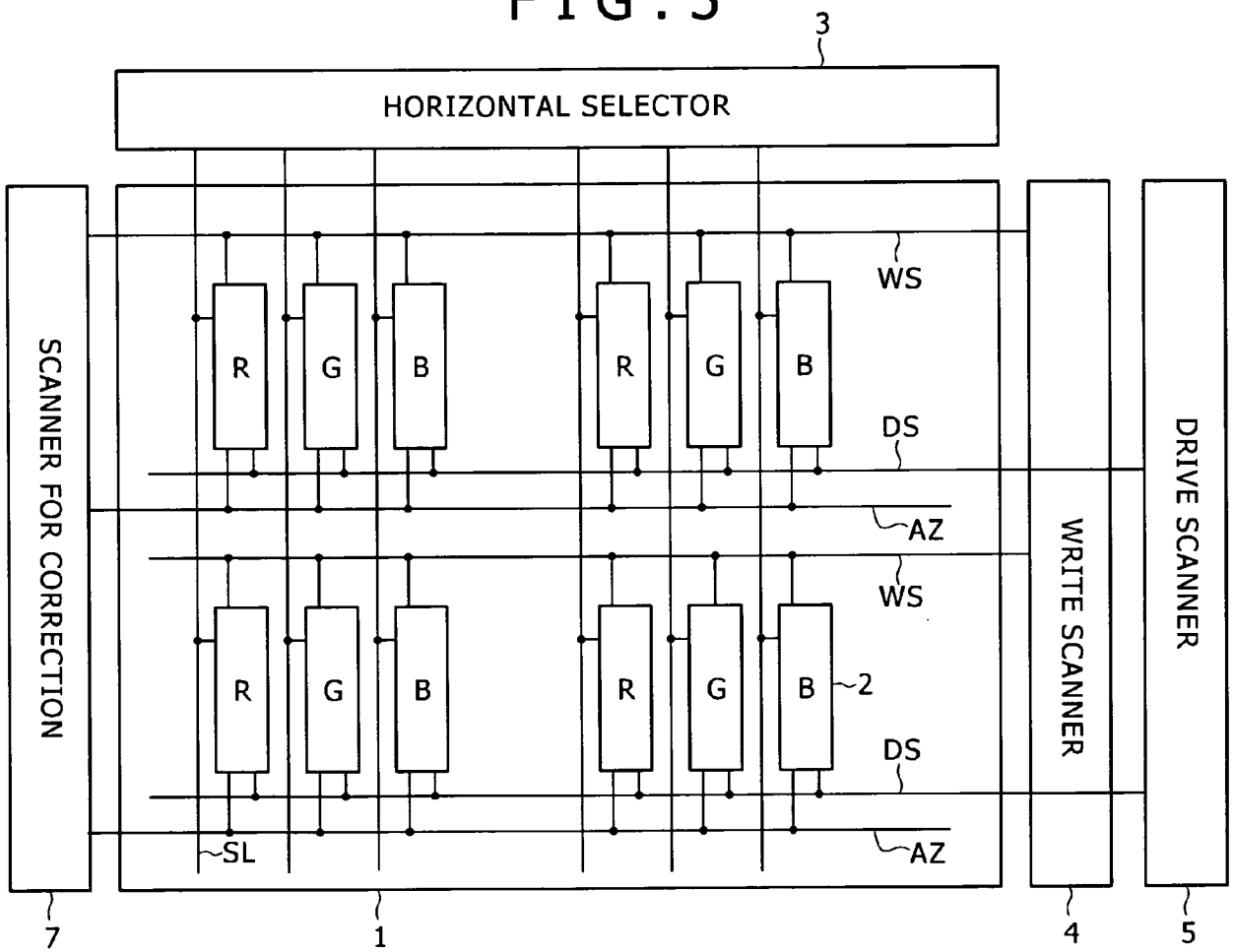
FIG. 5 is a block diagram showing an image display device according to a first embodiment of the present invention.

FIG. 5 is a block diagram showing an image display device according to a first embodiment of the present invention. In order to make understanding easy, portions corresponding to those of the preceding development example shown in FIG. 1 are designated with the corresponding reference numerals, respectively. As apparent from a comparison between the preceding development example and the first embodiment, the image display device of this embodiment has three scanning lines per row, the number of which is fewer than that of the four scanning lines per row in the preceding development example by one. That is to say, a main scanning line WS, a sub scanning lines DS, and a scanning line AZ for correction are formed in each of rows in a pixel array portion 1. A pixel circuit 2 is driven by using these three gate lines. A peripheral scanner portion includes a write scanner 4, a drive scanner 5, and a scanner 7 for correction in correspondence to these gate lines. Here, the write scanner 4 scans the main scanning lines WS. The drive scanner 5 scans the sub scanning lines DS. Also, the scanner 7 for correction scans the scanning lines AZ for correction. Thus, the number of scanners decreases from four to three, as compared with that in the preceding development example shown in FIG. 1.

Figure 6:
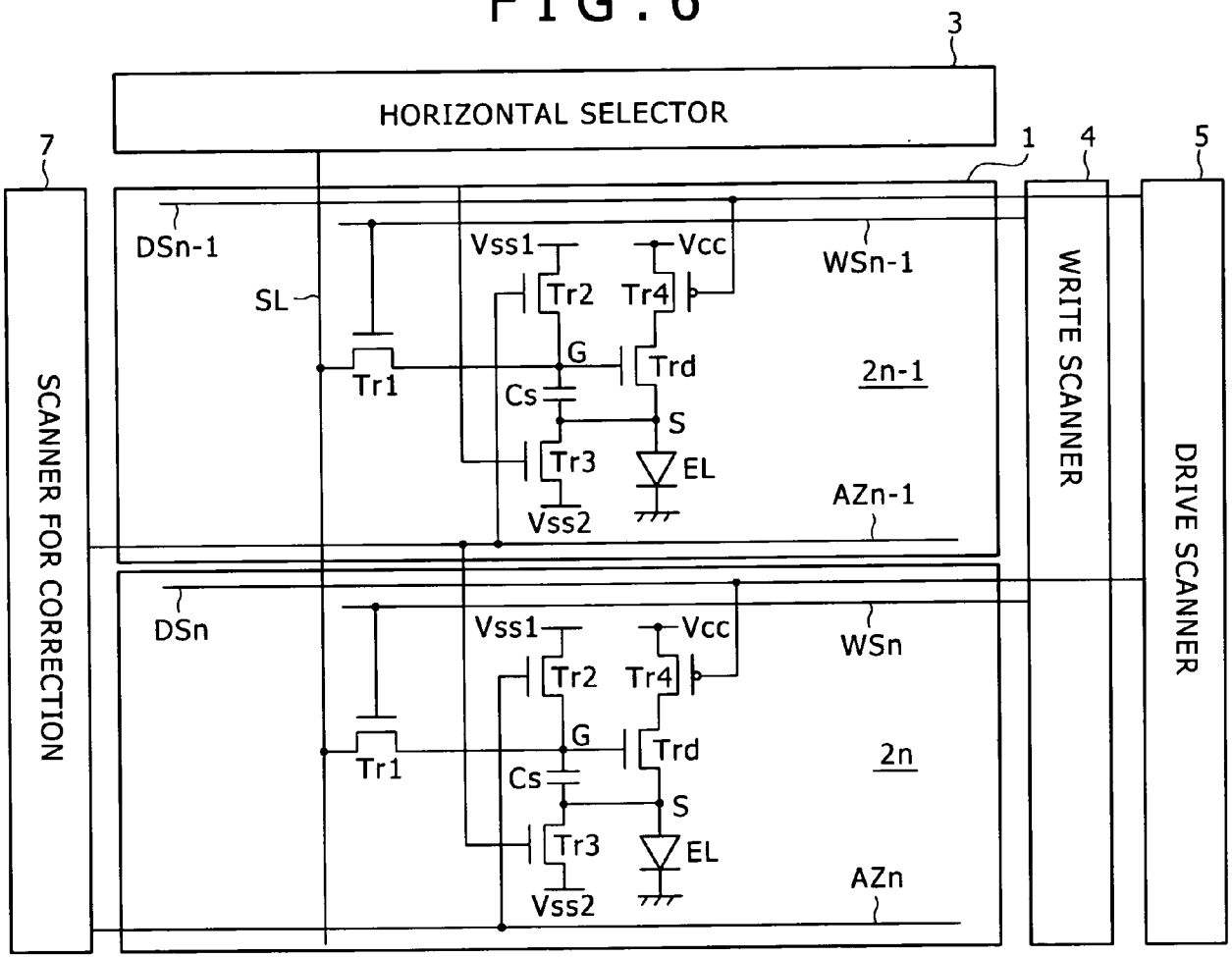
FIG. 6 is a circuit diagram showing a concrete structure of a pixel array in the image display device shown in FIG. 5 according to the first embodiment of the present invention.

FIG. 6 is a circuit diagram showing a concrete structure of the pixel circuit included in the image display device shown in FIG. 5. In order to make understanding easy, portions corresponding to those of the pixel circuit of the preceding development example shown in FIG. 2 are designated with the corresponding reference numerals, respectively. For the sake of convenience of a description, a pixel circuit 2*n* belonging to a row n (in an auto-stage) and a pixel circuit (2*n*−1) belonging to a row (n−1) (in a preceding stage) located before the row n by one are illustrated in a row in FIG. 6.

As shown in the figure, the pixel circuit 2*n* belonging to the row noticed (the row n concerned) includes a sampling transistor Tr1, a drive transistor Trd, a first switching transistor Tr2, a second switching transistor Tr3, a third switching transistor Tr4, a pixel capacitor Cs, and a light emitting element EL. The sampling transistor Tr1 is turned ON in accordance with a control signal supplied thereto from a main scanning line $WS_n$ for a predetermined period of time for sampling to sample and hold a signal potential of a video signal supplied thereto through a signal line SL in the pixel capacitor Cs. The pixel capacitor Cs applies an input voltage Vgs to a gate of the drive transistor Trd in accordance with the signal potential of the video signal thus sampled. The drive transistor Trd supplies an output current Ids corresponding to an input voltage Vgs to the light emitting element EL. The light emitting element EL emits a light with a luminance corresponding to the signal potential of the video signal by receiving an output current Ids supplied thereto from the drive transistor Trd for a predetermined period of time for light emission.

The first switching transistor Tr2 is turned ON in accordance with a control signal $AZ_n$ supplied thereto from the scanner 7 for correction prior to a period of time for sampling to set a potential of a gate G of the drive transistor Trd to a first reference potential Vss1. The second switching transistor Tr3 is similarly turned ON in accordance with a control signal $AZ_{n-1}$ supplied thereto from the scanner 7 for correction prior to the period of time for sampling to set a potential of a source S of the drive transistor Trd to a second reference potential Vss2. The third switching transistor Tr4 is turned ON in accordance with a control signal $DS_n$ supplied thereto through the sub scanning line prior to the period of time for sampling to connect the drive transistor Trd to a power source potential Vcc. As a result, the third switching transistor Tr4 causes the pixel capacitor Cs to hold therein a voltage corresponding to a threshold voltage Vth of the drive transistor Trd, thereby correcting an influence of the threshold voltage Vth. Also, the third switching transistor Tr4 is turned ON in accordance with the control signal $DS_n$ supplied thereto through the sub scanning line again for the period of time for light emission to connect the drive transistor Trd to the power source potential Vcc. As a result, the output current Ids is caused to flow through the light emitting element EL.

As for the characteristic matters of this embodiment of the present invention, one of the first switching transistor Tr2 and the second switching transistor Tr3 operates by receiving the control signal $AZ_n$ from the scanner 7 for correction through the scanning line $AZ_n$ for correction belonging to the row concerned. Also, the other of the first switching transistor Tr2 and the second switching transistor Tr3 operates by receiving the control signal $AZ_{n-1}$ from the scanner 7 for correction through the scanning line $AZ_{n-1}$ for correction belonging either to the row (n−1) before the row concerned or to a row after the row concerned. Thus, the first switching transistor Tr2 and the second switching transistor Tr3 use the scanning line AZ for correction in common. In particular, in this embodiment, the first switching transistor Tr2 operates by receiving the control signal $AZ_n$ from the scanner 7 for correction through the scanning line $AZ_n$ for correction belonging to the row n concerned. Also, the second transistor Tr3 operates by receiving the control signal AZ from the scanner 7 for correction through the scanning line AZ for correction belonging either to the row (n+1) right before the row n concerned or to the row (n−1) right after the row concerned. In particular, in this embodiment, the second switching transistor Tr3 operates by receiving the control signal $AZ_{n-1}$ from the scanner 7 for correction through the scanning line $AZ_{n-1}$ for correction belonging to the row (n−1) right before the row concerned. The gate line belonging either to the adjacent row right before the row concerned or to the adjacent row right after the row concerned is utilized in such a manner, thereby reducing the number of overlaps of the control lines with the signal lines and the power source lines as much as possible. Note that, a time width of the control signal AZ which the scanner 7 for correction supplies to the scanning line AZ for correction is set longer than a period of time (a period of time for Vth correction) necessary for correction of an influence of the threshold voltage Vth. The time width (pulse width) of the control signal AZ for correction, for example, can be set to one horizontal period (1H) or two horizontal periods (2H), or two or more horizontal periods. The potential of the gate G or the source S of the drive transistor Trd can be sufficiently initialized to a predetermined reference potential as the pulse width is longer.

The output current Ids of the drive transistor Trd has a dependency on the carrier mobility μ as well in the channel region. The third switching transistor Tr4 is turned ON for a period of time for sampling to connect the drive transistor Trd to the power source potential Vcc. Also, the third switching transistor Tr4 takes out the output current Ids from the drive transistor Trd while the signal potential is sampled, and negatively feeds the output current Ids back to the pixel capacitor Cs, thereby correcting the input voltage Vgs. As a result, the dependency of the output current Ids on the carrier mobility μ is canceled.

Figure 7:
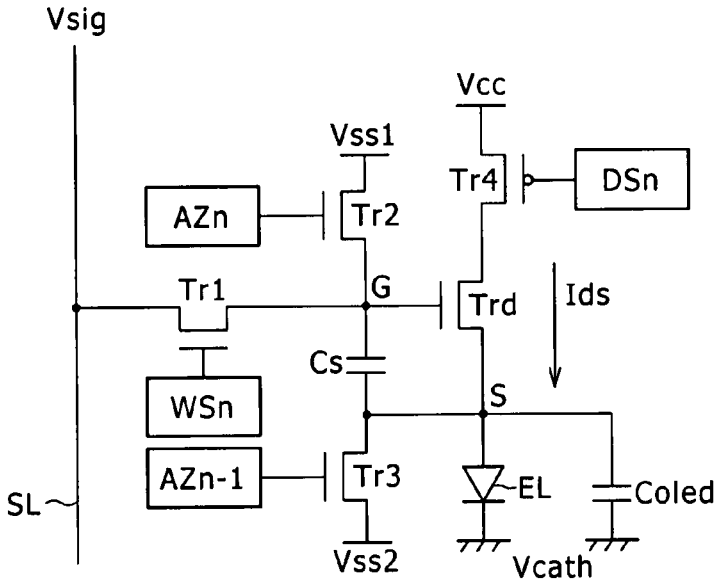
FIG. 7 is a schematic diagram showing the pixel circuit shown in FIG. 6 according to the first embodiment of the present invention.

FIG. 7 is a schematic diagram showing the pixel circuit 2*n* taken out from the image display device shown in FIG. 6. In order to make understanding easy, a video signal Vsig, an input voltage Vgs and the output current Ids of the drive transistor Trd, a capacitance component Coled which the light emitting element EL has, and the like are additionally illustrated in FIG. 7. Here, the video signal Vsig is sampled by the sampling transistor Tr1. The pixel circuit 2*n* has basically the same structure as that of the pixel circuit of the preceding development example shown in FIG. 3. The pixel circuit 2*n* of the first embodiment shown in FIG. 7 is different from that of the preceding development example in that the pixel circuit of the preceding development example has the two control lines AZ1 and AZ2 for correction, whereas the pixel circuit 2*n* of the first embodiment has the one scanning line AZ for correction. However, the row n concerned shares the scanning line AZ for correction with the row (n−1) right before the row n concerned. That is to say, the gate of the first switching transistor Tr2 is connected to the scanning line $AZ_n$ for correction belonging to the row n concerned, whereas the gate of the second switching transistor Tr3 is connected to the scanning line $AZ_{n-1}$ belonging to the row (n−1) right before the row n concerned. A pair of first and second switching transistors Tr2 and Tr3 uses the scanning line AZ for correction in common in a time division manner.

Figure 8:
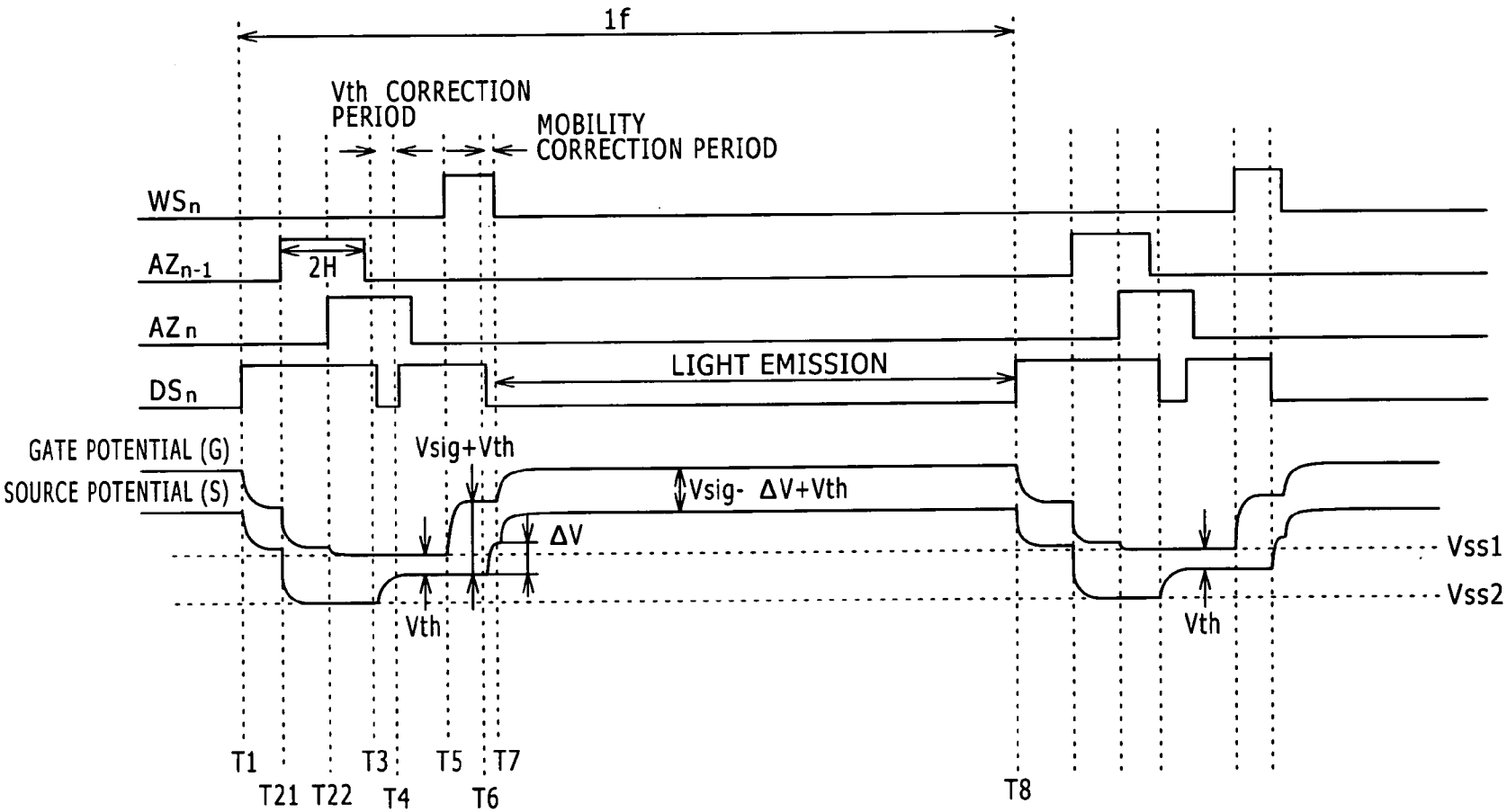
FIG. 8 is a timing chart explaining an operation of the pixel circuit shown in FIG. 7 of the image display device according to the first embodiment of the present invention.

FIG. 8 is a timing chart explaining an operation of the pixel circuit 2*n* in the image display device according to the first embodiment of the present invention. In order to make understanding easy, a notation similar to that in FIG. 4 showing the timing chart in the preceding development example is adopted in FIG. 8. The time chart in the first embodiment is different from that in the preceding development example in that the control signal $AZ_{n-1}$ in the row right before the row concerned is applied to the gate of the second switching transistor Tr3, and the control signal $AZ_n$ in the row n concerned is applied to the gate of the first switching transistor Tr2. Here, a pulse width of the control signal AZ for correction is set to 2H. However, the present invention is not intended to be limited thereto. That is to say, 1H, or 3H, or more also may be available for the pulse width of the control signal AZ for correction. However, the pulse width of the control signal AZ for correction needs to be set longer than a period of time for Vth correction from a timing T3 to a timing T4.

Firstly, the control signal $DS_n$ is changed from a low level over to a high level at a timing T1 to turn OFF the third switching transistor Tr4. After that, the control signal $AZ_{n-1}$ rises at a timing T21 to turn ON the second switching transistor Tr3. As a result, the second reference potential Vss2 is written to the source S of the drive transistor Trd. At this time, the potential of the gate G of the drive transistor Trd similarly drops so as to follow the drop of the potential of the source S of the drive transistor Trd because of a high impedance. Next', when the control signal $AZ_n$ rises at a timing T22 to turn ON the first switching transistor Tr2, the first reference potential Vss1 is written to the gate of the drive transistor Trd. In these operations, the control signals AZn and $AZ_{n-1}$ are shift register pulses which are successively outputted from respective shift registers having the same scanner. Thus, phases of—the control signals $AZ_n$ and $AZ_{n-1}$ are shifted from each other by 1 H.

Here, a relationship of (Vss1−Vss2)>Vth is met, and thus a relationship of (Vss1−Vss2=Vgs>Vth) is set, thereby preparing for the subsequent operation for the Vth correction. In addition, when the threshold voltage of the light emitting element EL is designated with VthEL, a relationship of VthEL>Vss2 is set, thereby applying a minus bias to the light emitting element EL. This operation is necessary for subsequently, normally performing the operation for Vth correction and the operation for mobility μ correction.

Next, the third switching transistor Tr4 is turned OFF at a timing T3 after the second switching transistor Tr3 is turned OFF, thereby starting the operation for Vth correction. At this time, the potential of the gate G of the drive transistor Trd is fixed at the first reference potential Vss1, and thus the output current Ids is continuously caused to flow until the drive transistor Trd is cut off. When the drive transistor Trd is cut off, the potential of the source S of the drive transistor Trd is set to (Vss1−Vth). In such a manner, the threshold voltage Vth is written to the pixel capacitor Cs.

After that, similarly to the pixel circuit in the preceding development example, the sampling transistor Tr1 is turned ON to write the signal voltage to the pixel capacitor Cs. Also, the third switching transistor Tr4 is turned ON, so that the operation enters the light emission operation. It could be confirmed that performing the above operation results in the correction operation being normally performed that even when the first and second switching transistors Tr2 and Tr3 use the scanning line AZ for correction in common. With such a circuit structure, the number of gate lines can be reduced by one kind of gate line as compared with that in the preceding development example. The reduction in number of gate lines results in a reduction in number of wiring crossovers, which leads to an improvement in the yield. Note that, in this embodiment, the mobility μ also is corrected for a period of time from the timing T6 to the timing T7. However, even with a simple pixel circuit, only for a Vth correcting operation, which has the control signals $WS_n$ and $DS_n$ disposed in a non-overlap manner, and which performs no mobility correction, likewise, the scanning line AZ for correction can be used in common.

Figure 9:
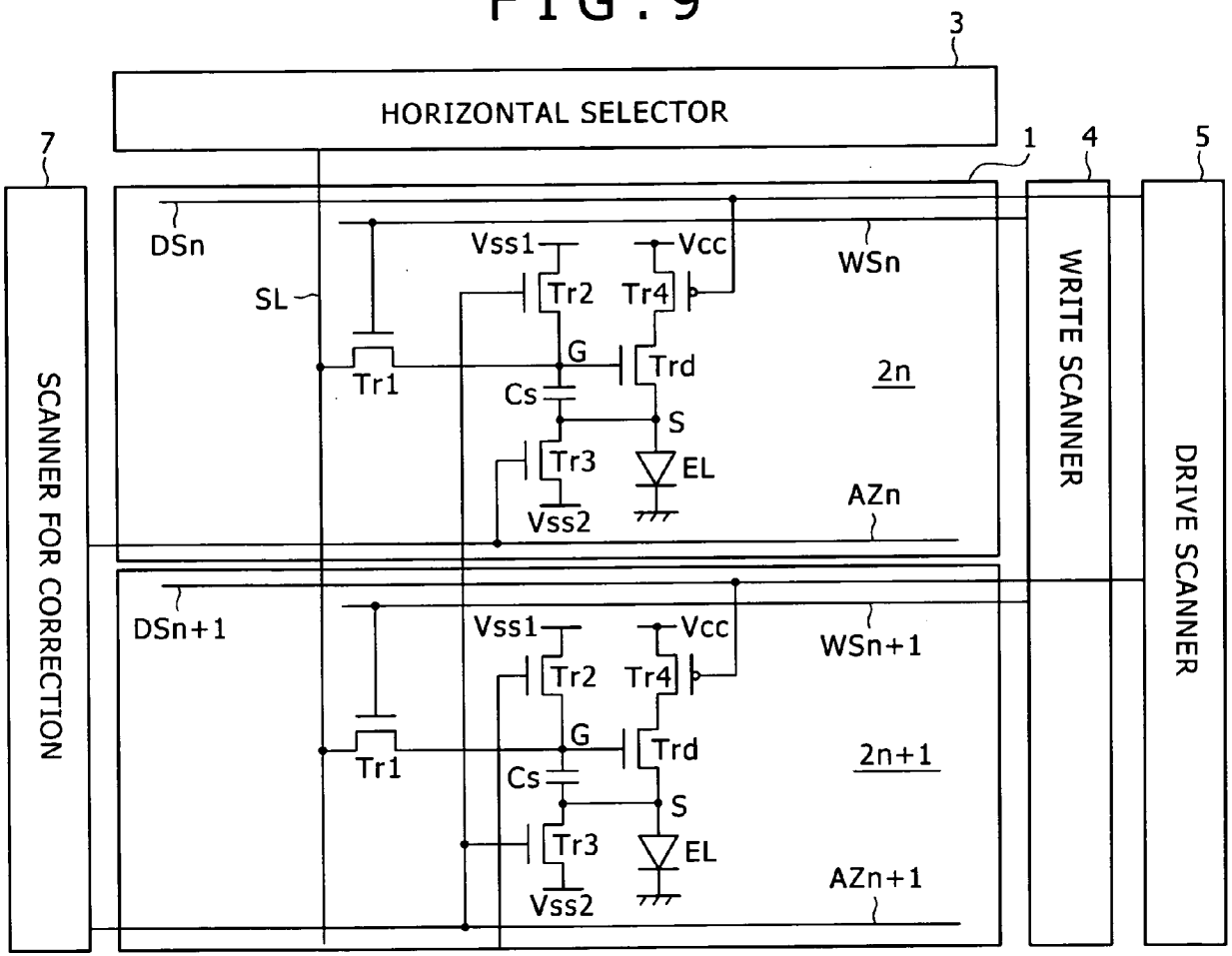
FIG. 9 is a circuit diagram showing an image display device according to a second embodiment of the present invention.

FIG. 9 is a block diagram, partly in circuit structure, showing an entire structure of an image display device according to a second embodiment of the present invention. In order to make understanding easy, portions corresponding to those in the first embodiment shown in FIG. 6 are designated with the corresponding reference numerals, respectively. A pixel circuit 2*n* belonging to the row concerned (in an auto-stage) and a pixel circuit (2*n*+1) belonging to a row (n+1)(in a next stage) right after the row concerned are illustrated on upper and lower sides, respectively, in FIG. 9. As can be seen from the figure, in the pixel circuit 2*n* belonging to the row n concerned, a scanning line $AZ_n$ for correction belonging to the row n concerned is connected to one switching transistor Tr3. Also, a scanning line $AZ_{n+1}$ for correction not belonging to the row n concerned, but belonging to a row (n+1) right after the row n concerned, is connected to a gate of the other switching transistor Tr2. These scanning lines $AZ_n$ and AZn+1 for correction are scanned in a one pass scan manner by a scanner 7 for correction.

Figure 10:
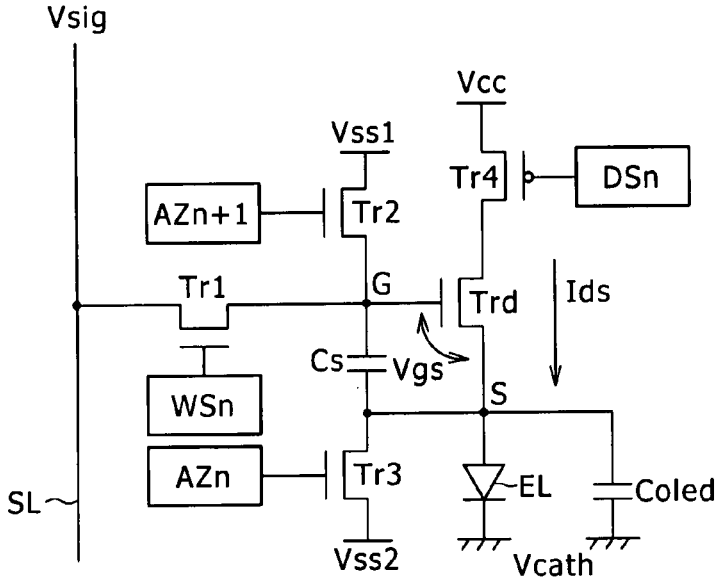
FIG. 10 is a schematic diagram showing a structure of a pixel circuit in the image display device shown in FIG. 9 according to the second embodiment of the present invention.

FIG. 10 is a schematic diagram of the pixel circuit belonging to the row n taken out from the image display device shown in FIG. 9. In order to make understanding easy, portions corresponding to those in the pixel circuit of the first embodiment shown in FIG. 7 are designated with the corresponding reference numerals, respectively. The pixel circuit of this embodiment is different from the pixel circuit of the first embodiment in that the scanning line $AZ_{n-1}$ for correction in a next stage is connected to the gate of the switching transistor Tr2 and the scanning line $AZ_n$ for correction in an auto-stage stage is connected to the gate of the switching transistor Tr3. A pair of switching transistors Tr2 and Tr3 uses the scanning line AZ for correction in common in such a manner, thereby reducing the number of gate lines necessary for each row by one.

Figure 11:
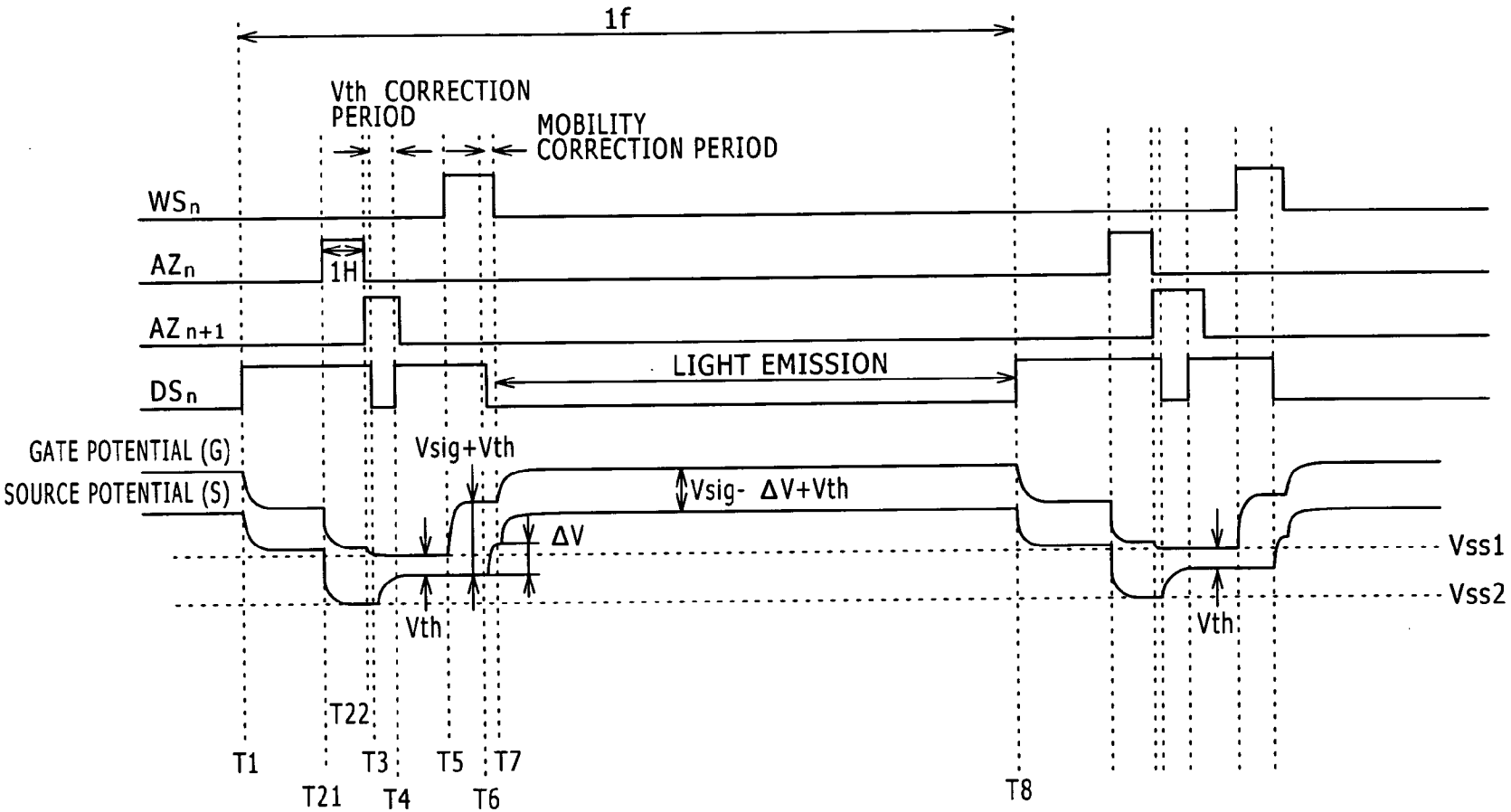
FIG. 11 is a timing chart explaining an operation of the pixel circuit shown in FIG. 10 of the image display device according to the second embodiment of the present invention.

FIG. 11 is a timing chart explaining an operation of the pixel circuit 2*n* in the image display device according to the second embodiment of the present invention. In order to make understanding easy, a notation similar to that in the timing chart in the first embodiment shown in FIG. 8 is adopted in FIG. 11. As shown in the figure, the control signal $AZ_n$ in the auto-stage n is applied to the gate of the second switching transistor Tr3. Also, the control signal $AZ_{n+1}$ in the next stage (n+1) is applied to the gate of the first switching transistor Tr2. More specifically, after the third switching transistor Tr4 is turned OFF at a timing T1, so that the operation enters a period of time for non-light emission, the control signal $AZ_n$ rises at a timing T21 to turn ON the second switching transistor Tr3. As a result, the second reference potential Vss2 is written to the source S of the drive transistor Trd. Moreover, at the same time that the control signal $AZ_n$ drops at a timing T22 to turn OFF the second switching transistor Tr3, the control signal $AZ_{n+1}$ rises at the timing T22 to turn ON the first switching transistor Tr2. As a result, the first reference potential Vss1 is written to the gate G of the drive transistor Trd. The preparation for the operation for Vth correction is completed through the above operation. That is to say, the potentials of the source S and the gate G of the drive transistor Trd are initialized to predetermined reference potentials, respectively. In this embodiment, moreover, the third switching transistor Tr4 is turned ON for a period of time from the timing T3 to the timing T4, thereby performing the operation for Vth correction. The subsequent operation is similar to that in the first embodiment. Here, in this embodiment, a pulse width of the control signal AZ is set as 1 H. This pulse width is just identical to that of the control signal WS in accordance with which the video signal is sampled.

Figure 12:
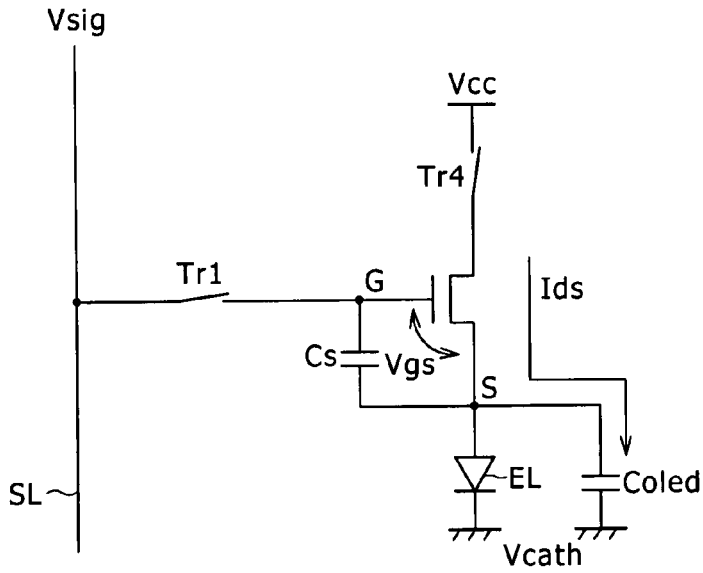
FIG. 12 is a circuit diagram explaining an operation of the pixel circuit in the image display device according to the second embodiment of the present invention.

Finally, FIG. 12 is a circuit diagram showing a state of the pixel circuit 2*n* for a period of time for mobility correction from the timing T6 to the timing T7. As shown in the figure, for the period of time for mobility correction from the timing T6 to the timing T7, each of the sampling transistor Tr1 and the third switching transistor Tr4 is in the ON state, while each of the remaining transistors is in the OFF state. In this state, a source potential (S) of the drive transistor Tr4 is held at (Vss1−Vth). This source potential S is also an anode potential of the light emitting element EL. As previously described, the relationship of (Vss1−Vth<VthEL) is set, which results in that the light emitting element EL being put in the reverse bias state. As a result, the light emitting element EL does not show the diode characteristics, but shows the simple capacitance characteristics. Hence, the drain current Ids which is caused to flow through the drive transistor Trd is caused to flow into a composite capacitor C=Cs+Coled where Cs is the pixel capacitor, and Coled, is the equivalent capacitance component of the light emitting element EL. In other words, a part of the drain current Ids is negatively fed back to the pixel capacitor Cs, thereby correcting the mobility μ.

Figure 13:
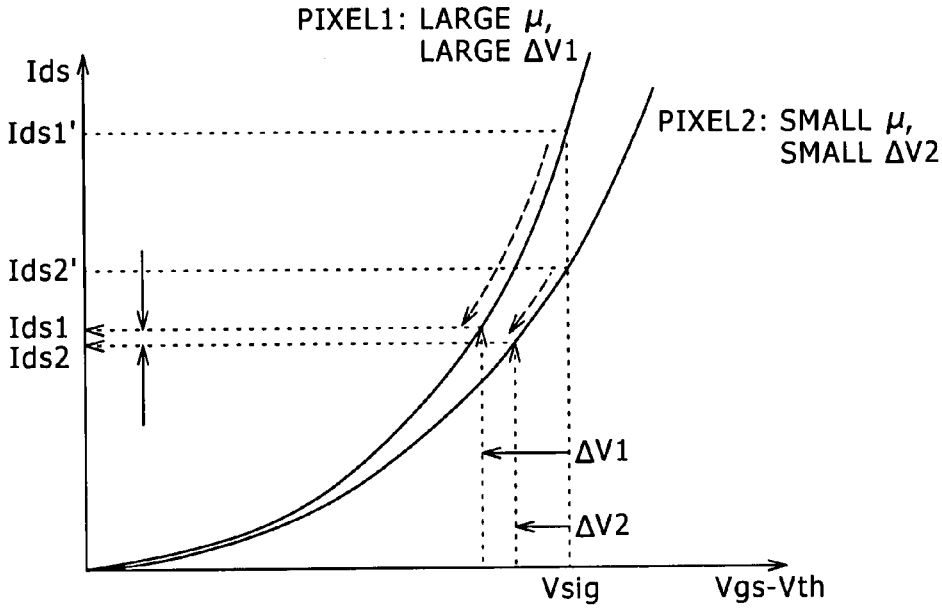
FIG. 13 is a graph explaining a relationship between a video signal and an output current in the image display device according to the second embodiment of the present invention.

FIG. 13 is a graph showing a relationship between the video signal Vsig and the output current Ids. That is to say, Expression (2) as the transistor characteristic expression is expressed in the form of the graph. In the figure, axis of ordinate represents the output current Ids, and the axis of abscissa represents the video signal Vsig. Expression (2) is mentioned together below the graph in FIG. 13. The graph of FIG. 13 shows the characteristic curves in a state in which the pixels 1 and 2 are compared with each other. The mobility μ of the drive transistor in the pixel 1 is relatively large. Conversely, the mobility μ of the drive transistor included in the pixel 2 is relatively small. As apparent from this fact, when the drive transistor is constituted by a polysilicon thin film transistor or the like, it is not avoided that the mobility μ disperses among the pixels. For example, when the video signals Vsig having the same level are written to the pixels 1 and 2, respectively, if no mobility correction is performed at all, a large difference is generated between an output current Ids1' and an output current Ids2'. Here, the output current Ids1' is caused to flow through the pixel 1 having the larger mobility μ, and the output current Ids2' is caused to flow through the pixel 2 having the smaller mobility μ. The large difference is generated between the output currents Ids1' and Ids2' due to the dispersion of the mobility μ as described above, which impairs the uniformity of the picture.

Thus, in each of the embodiments of the present invention, the output current is negatively fed back to the input voltage side, thereby canceling the dispersion of the mobility. As apparent from Expression (2), the drain current Ids becomes large as the mobility μ is larger. Therefore, the amount, ΔV, of output current Ids negatively fed back to the input voltage Vgs becomes large as the mobility μ is larger. As shown in the graph of FIG. 13, the amount, ΔV1, of output current Ids negatively fed back to the input voltage Vgs of the pixel 1 having the larger mobility μ is larger than the amount, ΔV2, of output current Ids negatively fed back to the input voltage Vgs of the pixel 2 having the smaller mobility μ. Therefore, the large amount of output current Ids is negatively fed back to the input voltage Vgs as the mobility μ is larger, thereby making it possible to suppress the dispersion of the mobility μ. As shown in the figure, when the correction of ΔV1 is performed in the pixel 1 having the larger mobility μ, the output current largely drops from Ids1' to Ids1. On the other hand, since the amount, ΔV2, of correction in the pixel 2 having the smaller mobility μ is small, the output current merely drops from Ids2' to Ids2, and thus does not drop so much. As a result, the output current Ids1 in the pixel 1 becomes approximately equal to the output current Ids2, thereby canceling the dispersion of the mobility μ. Since the dispersion of the mobility μ is canceled over the full range of the video signal Vsig from a black level to a white level, the uniformity of the picture becomes extremely high. The above is summarized as follows. When there are pixels 1 and 2 having different mobilities, the amount, ΔV1, of correction in the pixel 1 having the larger mobility is smaller than the amount, ΔV2, of correction in the pixel 2 having the smaller mobility. That is to say, the amount, ΔV, of correction is large and the reduction in output current Ids is large as the mobility is larger. As a result, the current values in the pixels having the different mobilities can be confirmed, thereby correcting the dispersion of the mobility.

Figure 14:
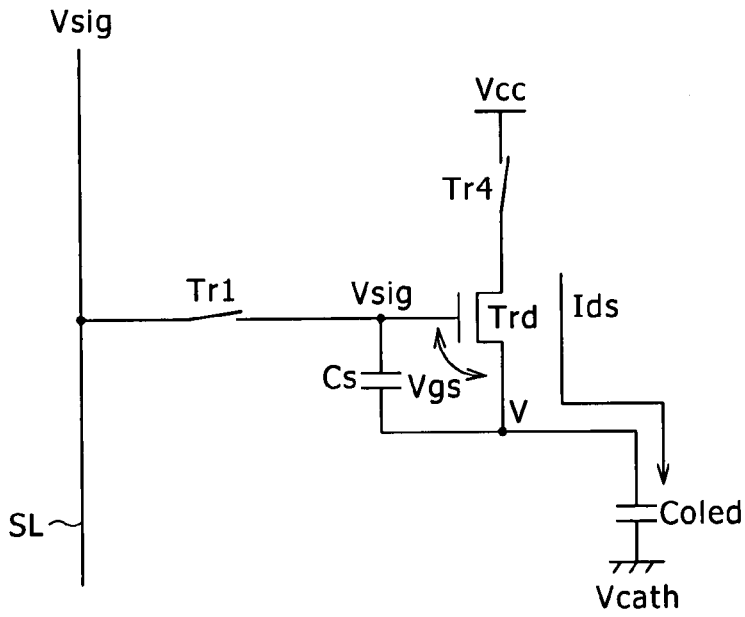
FIG. 14 is a circuit diagram explaining the operation of the pixel circuit in the image display device according to the second embodiment of the present invention.

For reference, a numerical analysis for the above-mentioned mobility correction will be performed hereinafter with reference to FIG. 14. The analysis is performed under a condition that the source potential of the drive transistor Trd is treated as a variable V in a state in which each of the transistors Tr1 and Tr4 is in the ON state as shown in FIG. 14. When the source potential (S) of the drive transistor Trd is V, the drain current Ids caused to flow through the drive transistor Trd is given by Expression (3):

$$I_{ds}=k\mu(V_{gs}-V_{th})^2=k\mu(V_{sig}-V-V_{th})^2 \quad (3)$$

In addition, a relationship of Ids=dQ/dt=CdV/dt is established as shown in Expression (4) from the relationship of the drain current Ids and the composite capacitor C (=Cs+Coled).

$$\begin{aligned} I_{ds} &= \frac{dQ}{dt} = C\frac{dV}{dt} \quad \int \frac{1}{C}dt = \int \frac{1}{I_{ds}}dV \\ &\Leftrightarrow \int_0^t \frac{1}{C}dt = \int_{V_{th}}^{V} \frac{1}{k\mu(V_{sig}-V_{th}=V)^2}dV \\ &\Leftrightarrow \frac{k\mu}{C}t = \left[\frac{1}{V_{sig}-V_{th}-V}\right]_{-V_{th}}^{V} = \frac{1}{V_{sig}-V_{th}-V} - \frac{1}{V_{sig}} \\ &\Leftrightarrow V_{sig}-V_{th}-V = \frac{1}{\frac{1}{V_{sig}}+\frac{k\mu}{C}t} = \frac{V_{sig}}{1+V_{sig}\frac{k\mu}{C}t} \end{aligned} \quad (4)$$

Expression (4) is substituted into Expression (3), and both members of Expression (3) are then integrated. Here, it is assumed that an initial state of the source voltage is given by −Vth and the period of time for correction for the dispersion of the mobility (from the timing T6 to the timing T7) is t. When this differential equation is solved, the relationship between the period, t, of time for mobility correction, and the pixel current Ids is given by Expression (5):

$$I_{ds} = k\mu\left(\frac{V_{sig}}{1+V_{sig}\frac{k\mu}{C}t}\right)^2 \quad (5)$$

Figure 15:
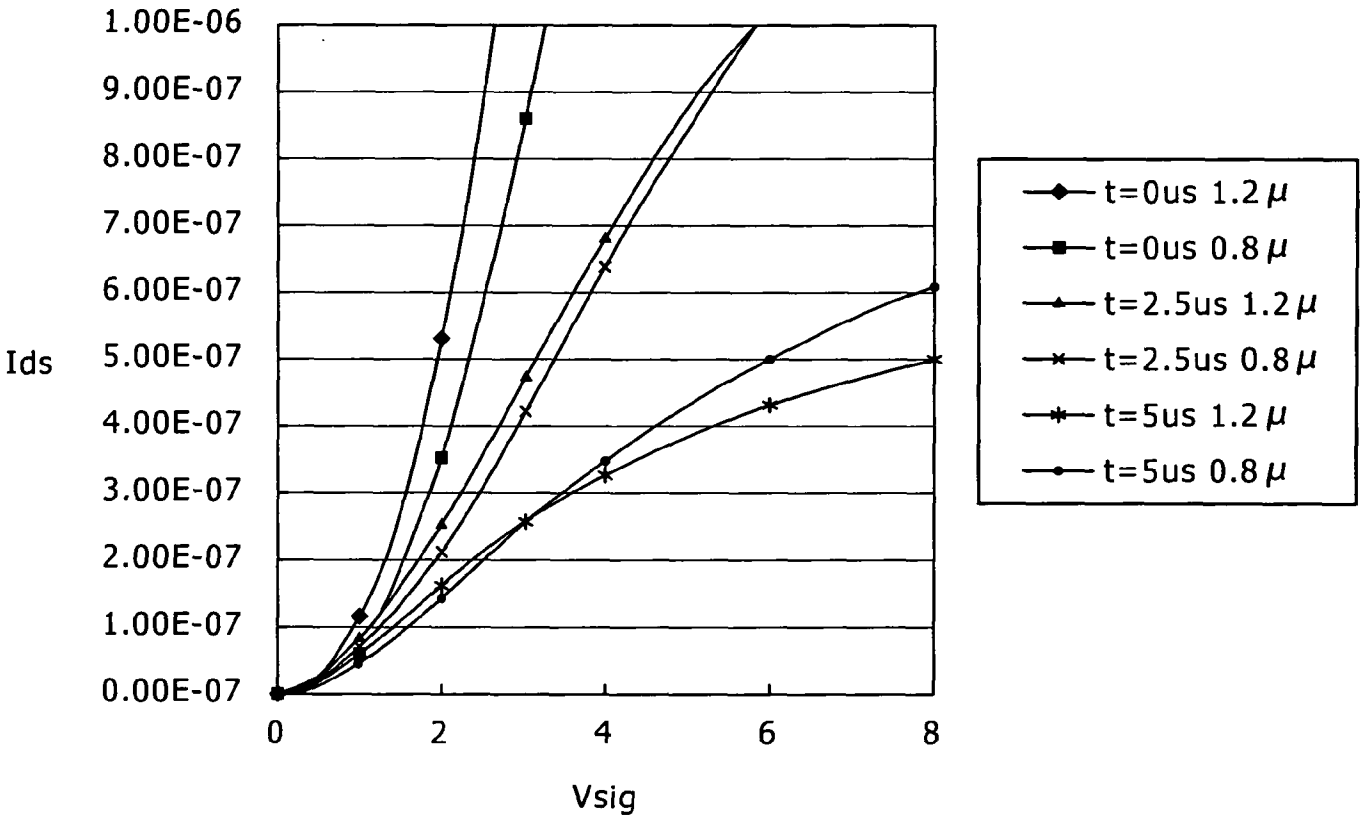
FIG. 15 is a graph explaining another relationship between the video signal and the output current in the image display device according to the second embodiment of the present invention.

FIG. 15 is a graph showing another relationship between the video signal Vsig and the output current Ids. That is to say, Expression (5) is expressed in the form of the graph in FIG. 15. In the figure, the axis of ordinate represents the output current Ids, and the axis of abscissa represents the video signal Vsig. The period, t, of time for mobility correction (=0 us, 2.5 us and 5 us) is set as a parameter. Moreover, the relatively large mobility=1.2μ and the relatively small mobility=0.8μ are also set as another parameter. From the graph, it is understood that when t=2.5 us, the mobility dispersion is sufficiently corrected as compared with the case where t=0 us is set, and thus no mobility dispersion is substantially corrected. When no mobility dispersion is corrected, there is a dispersion of 40% in the output current Ids, whereas when the mobility dispersion is corrected, the dispersion is suppressed to 10% or less. However, when t=5 us is set to prolong the period of time for correction, conversely, the dispersion of the output current Ids increases due to the difference in the mobility μ. Thus, in order to suitably correct the mobility dispersion, t needs to be set to an optimal value. In the case of the graph shown in FIG. 15, the optimal value of t lies in the vicinity of 2.5 us.

Figure 16:
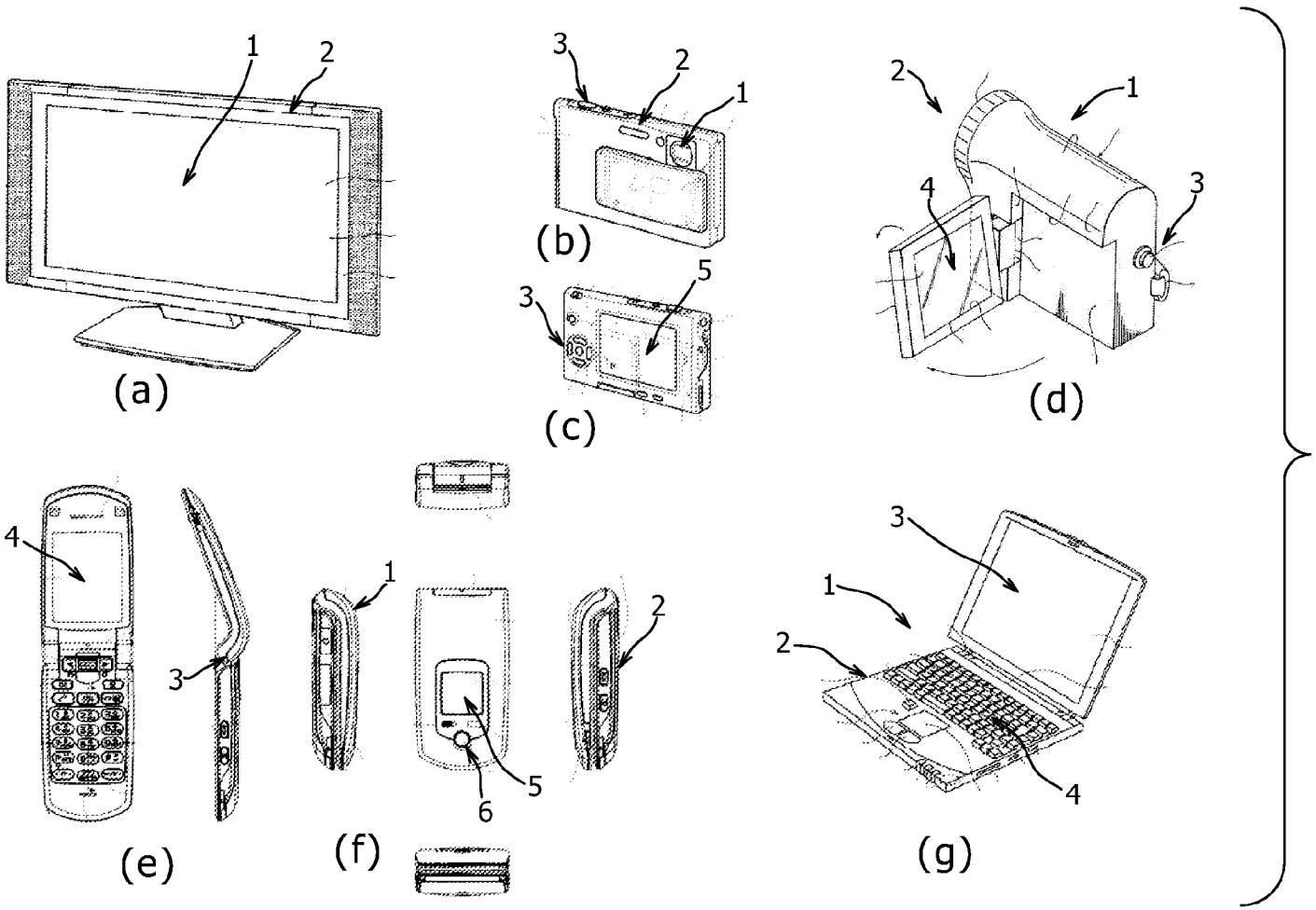
FIGS. 16(*a*) to 16(*g*) are respectively schematic views of examples of electronic apparatuses.

Each of the image display devices according to the first and second embodiments of the present invention can be applied to an image display device for use in electronic apparatuses in all the fields, that is, electronic apparatuses, as shown in FIGS. 16(*a*) to 16(*g*), such as a digital camera, a notebook type personal computer, a mobile phone, and a video camera. Here, the image display device for use therein displays a video signal which is inputted to the electronic apparatus or is generated in the electronic apparatus in the form of an image or a reflection.

Figure 17:
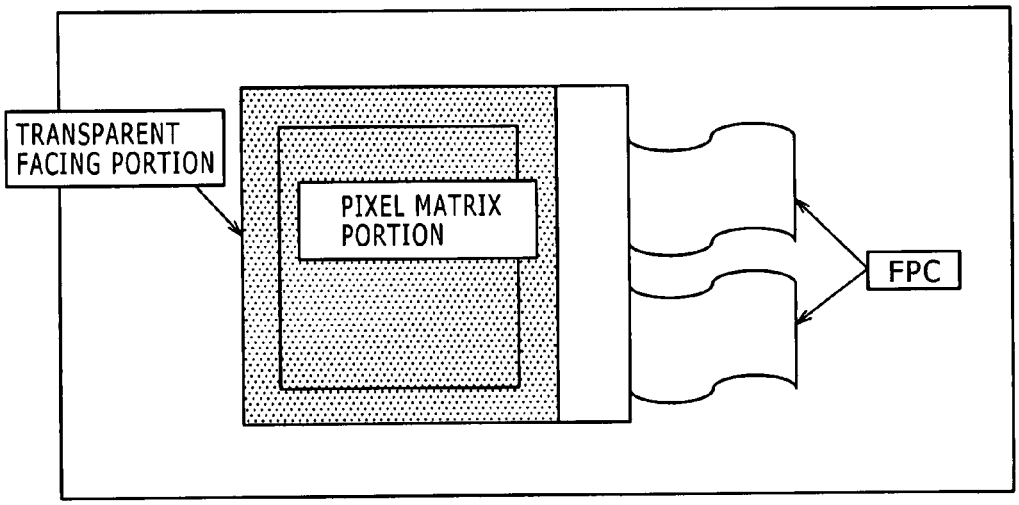
FIG. 17 is a schematic view of an external form of a device.

Note that, each of the image display devices according to the first and second embodiments includes has a module shape as illustrated in FIG. 17. For example, a display module in which a pixel array portion is stuck to a transparent facing portion such as a glass corresponds to the module shape stated above. A color filter, a protective film, a light shielding film, and the like may be provided in this transparent facing portion. Note that, a flexible printed circuit (FPC) with which signals or the like are transmitted between the outside and a pixel array portion may be provided in the display module.

Examples of the electronic apparatuses to which such an image display device according to each of the first and second embodiments of the present invention is applied will be described hereinafter with reference to FIGS. 16(*a*) to 16(*g*).

FIG. 16(*a*) shows a television to which the image display device according to each of the first and second embodiments of the present invention is applied. This television includes an image display screen 1 constituted by a front panel 2 and the like, and is manufactured by using the image display device according to each of the first and second embodiments of the present invention in the image display screen 1.

FIGS. 16(*b*) and 16(*c*) show digital cameras, respectively, to each of which the image display device according to each of the first and second embodiments of the present invention is applied. Each of the digital cameras includes an image pick-up lens 1, a light emitting portion 2 for flash, a display portion 5, a menu switch 3, a shutter 4 and the like, and is manufactured by using the image display device according to each of the first and second embodiments of the present invention in the display portion 5.

FIG. 16(*d*) shows a video camera to which the image display device according to each of the first and second embodiments of the present invention is applied. This video camera includes a main body portion 1, a lens 2 for capturing an image of a subject, a start/stop switch 3 with which image capturing is started/stopped, a display portion 4, and the like. Here, the lens 2, the start/stop switch 3, the display portion 4, and the like are provided in a side face directed to the front. Also, this video camera is manufactured by using the image display device according to each of the first and second embodiments of the present invention in the display portion 4.

FIGS. 16(*e*) and 16(*f*) show mobile terminal apparatuses, respectively, to each of which the image display device according to each of the first and second embodiments of the present invention is applied. Each of the mobile terminal apparatuses includes an upper side chassis 1, a lower side chassis 2, a coupling portion (a hinge portion in this case) 3, a display device 4, a sub display device 5, a camera 6, and the like. Also, each of the mobile terminal apparatuses is manufactured by using the image display device according to each of the first and second embodiments of the present invention in each of the display device 4 and the sub display device 1.

Also, FIG. 16(*g*) shows a notebook type personal computer 1 to which the image display device according to each of the first and second embodiments of the present invention is applied. A main body 2 of the notebook type personal computer 1 includes a keyboard 4 which is manipulated when characters or the like are inputted, a display portion 3 for displaying thereon an image, and the like. The notebook type personal computer 1 is manufactured by using the image display device according to each of the first and second embodiments of the present invention in the display portion 3.

It should be understood by those skilled in the art that various modifications, combinations, subcombinations and alterations may occur depending on design requirements and other factors insofar as they are within the scope of the appended claims or the equivalents thereof.

What is claimed is:

1. An image display device comprising:

row scan lines configured to supply control signals;

column signal lines configured to supply a video signals; and pixel circuits disposed at intersections between the row scan lines and the column signal lines, each of the pixel circuits including a drive transistor having a first source/drain area connected to a light emitting element;

a first switching transistor having a first source/drain area connected to a first reference potential and a second source/drain area connected to a gate of the drive transistor, a gate of the first switching transistor being connected to a first row scan line;

a second switching transistor having a first source/drain area connected to a second reference potential and a second source/drain area connected to the first source/drain area of the drive transistor, a gate of the second switching transistor being connected to a second row scan line; and a third switching transistor having a first source/drain area connected to a power source and a second source drain area connected to a second source/drain area of the drive transistor, a gate of the third switching transistor being connected to a fourth row scan line;

wherein one of said first row scan line and said second row scan line is connected to a scan line for correction of another pixel circuit in the next row; and wherein said third switching transistor is connected to said drive transistor and is configured to turn on at a start of a mobility correction period performed for a period of time in which an end portion of a period of time for sampling, and a lead portion of a period of time for light emission overlap each other, that precedes light-emission of the light emitting element.

2. The image display device according to claim 1, further comprising a sampling transistor having a first source/drain area connected to a column signal line and a second source/drain area connected to the gate of a drive transistor, a gate of the sampling transistor being connected to a third row scan line.

3. The image display device according to claim 2, wherein the fourth row scan line is a drive scan line connected to a drive scanner.

4. The image display device according to claim 1, further comprising a pixel capacitor connected between the gate of the drive transistor and the first source/drain area of the drive transistor.

5. The image display device according to claim 2, wherein the third row scan line is a write scan line connected to a write scanner.

6. The image display device according to claim 1, wherein a threshold correction period precedes the mobility correction period.

* * * * *